US010524575B2

(12) United States Patent
LaPointe

(10) Patent No.: US 10,524,575 B2
(45) Date of Patent: Jan. 7, 2020

(54) FURNITURE MEMBER WITH FOLDABLE PAWL AND RATCHET ASSEMBLY

(71) Applicant: La-Z-Boy Incorporated, Monroe, MI (US)

(72) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 79 days.

(21) Appl. No.: 15/954,164

(22) Filed: Apr. 16, 2018

(65) Prior Publication Data

US 2019/0313796 A1 Oct. 17, 2019

(51) Int. Cl.

| | |
|---|---|
| ***A47C 1/0355*** | (2013.01) |
| ***A47C 7/60*** | (2006.01) |
| ***A47C 7/56*** | (2006.01) |

(52) U.S. Cl.

CPC ..... *A47C 1/0355* (2013.01); *A47C 7/563* (2013.01); *A47C 7/60* (2013.01)

(58) Field of Classification Search

CPC ..... A47C 1/0355; A47C 7/563; A47C 7/60
USPC ..... 297/89, 270.1, 423.19, 423.23
See application file for complete search history.

(56) References Cited

U.S. PATENT DOCUMENTS

| | | | |
|---|---|---|---|
| 203,602 | A | 5/1878 | Dietsch |
| 2,473,895 | A | 6/1949 | Mednick |
| 2,719,572 | A | 10/1955 | Goldberg |
| 2,772,723 | A | 12/1956 | Tunnell |
| 3,096,121 | A | 7/1963 | Knabusch et al. |
| 3,179,466 | A | 4/1965 | Garrett |
| 3,191,990 | A | 6/1965 | Rugg et al. |
| 3,302,969 | A | 2/1967 | Mizelle et al. |

(Continued)

FOREIGN PATENT DOCUMENTS

| | | | |
|---|---|---|---|
| CN | 200976974 | Y | 11/2007 |
| DE | 623960 | C | 1/1936 |

(Continued)

OTHER PUBLICATIONS

International Search Report and Written Opinion of the International Searching Authority for PCT/US2006/031852, dated Jun. 17, 2008.

(Continued)

*Primary Examiner* — Syed A Islam
(74) *Attorney, Agent, or Firm* — Harness, Dickey & Pierce, P.L.C.

(57) ABSTRACT

A rocking furniture member may include a base frame, a seat assembly, a legrest mechanism, and a pawl assembly. The seat assembly may include a ratchet rack having a plurality of teeth. The pawl assembly may include a support link, a pawl arm, and an actuation link. The support link is rotatably coupled to the base frame. The pawl arm is rotatably attached to the support link and selectively engages one of the ratchet teeth. The actuation link may be attached to the pawl arm and may be coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack.

33 Claims, 22 Drawing Sheets

(56) References Cited

U.S. PATENT DOCUMENTS 3,352,601 A 11/1967 Cycowicz
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
4,099,776 A 7/1978 Crum
4,140,342 A 2/1979 Jones
4,179,157 A 12/1979 Shoemaker et al.
4,212,494 A 7/1980 Dabney
4,216,991 A 8/1980 Holobaugh
4,216,992 A 8/1980 Crum
4,226,468 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,996 A 2/1986 Rogers, Jr.
4,582,435 A 4/1986 Davis
4,601,513 A 7/1986 Pine
4,650,211 A 3/1987 Tanahashi
4,662,597 A 5/1987 Uecker et al.
4,740,031 A 4/1988 Rogers, Jr.
4,805,960 A 2/1989 Tacker
4,861,101 A 8/1989 Hartline
4,932,927 A 6/1990 Fillar
4,989,914 A 2/1991 Pine
5,011,220 A 4/1991 LaPointe
5,064,244 A 11/1991 Sproule
5,072,988 A 12/1991 Plunk
5,088,789 A 2/1992 LaPointe et al.
5,123,705 A 6/1992 Johnson
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,328,235 A * 7/1994 Saul ..... A47C 1/0352 297/270.1
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A 1/1996 May
5,480,213 A 1/1996 Sproule
5,527,095 A * 6/1996 Marshall ..... A47C 1/0352 297/258.1
5,567,009 A 10/1996 Fay et al.
5,570,927 A 11/1996 LaPointe et al.
5,570,930 A 11/1996 LaPointe et al.
5,597,209 A 1/1997 Bart et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,857,739 A 1/1999 Smith
5,865,457 A 2/1999 Knabusch et al.
5,954,392 A 9/1999 Liss et al.
5,971,475 A 10/1999 Lawson
5,975,627 A 11/1999 LaPointe et al.
6,000,754 A 12/1999 Lawson
6,179,328 B1 1/2001 Kawagoe et al.
6,309,015 B1 10/2001 Pine
6,330,995 B1 12/2001 Mangeiga et al.
6,467,845 B1 10/2002 Chen
6,488,332 B1 12/2002 Markwald
6,491,342 B1 12/2002 Smith
6,827,401 B2 12/2004 Marshall et al.
6,939,076 B2 9/2005 LaPointe
6,988,769 B2 * 1/2006 LaPointe ..... B60N 2/995 297/85 L
7,261,367 B2 8/2007 Duncan et al.
7,275,789 B2 10/2007 LaPointe
7,338,132 B2 * 3/2008 LaPointe ..... A47C 1/034 297/423.26
7,357,450 B2 4/2008 Rogers
7,431,387 B2 * 10/2008 LaPointe ..... A47C 1/0345 297/303.4
7,475,944 B2 1/2009 Griepentrog et al.
7,637,571 B2 12/2009 Okano et al.
7,673,933 B2 3/2010 Lawson
7,731,276 B2 6/2010 Hoffman et al.
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.
9,655,451 B2 5/2017 Harwood et al.
9,808,090 B2 11/2017 Carrera
9,986,832 B2 6/2018 LaPointe et al.
9,986,835 B2 6/2018 LaPointe et al.
10,092,106 B2 10/2018 LaPointe et al.
2003/0057743 A1 3/2003 May
2004/0000803 A1 1/2004 Guillot et al.
2005/0067867 A1 3/2005 May
2006/0061147 A1 3/2006 Johnson
2006/0103202 A1 5/2006 Maki et al.
2006/0249992 A1 11/2006 LaPointe et al.
2006/0249993 A1 11/2006 Rogers
2007/0040419 A1 2/2007 LaPointe et al.
2007/0085395 A1 4/2007 LaPointe
2007/0241589 A1 10/2007 LaPointe
2008/0150329 A1 6/2008 Lawson
2009/0284054 A1 11/2009 Humer et al.
2011/0175426 A1 7/2011 Lawson
2011/0233972 A1 9/2011 Weicek
2011/0248544 A1 10/2011 Adams et al.
2011/0248547 A1 10/2011 LaPointe et al.
2011/0304193 A1 12/2011 Murphy et al.
2012/0193946 A1 8/2012 Robertson
2013/0062914 A1 3/2013 Marshall et al.
2013/0140855 A1 6/2013 Murphy et al.
2013/0175847 A1 7/2013 Lawson
2014/0049079 A1 2/2014 Lawson et al.
2014/0049084 A1 2/2014 Lawson et al.
2014/0070585 A1 3/2014 LaPointe
2014/0103688 A1 4/2014 Wilson
2014/0312660 A1 10/2014 Natuzzi et al.
2014/0333099 A1 11/2014 Lu et al.
2015/0196123 A1 7/2015 Buehrer
2015/0250320 A1 9/2015 Arceci et al.
2015/0272329 A1 10/2015 Lawson
2015/0282619 A1 10/2015 Lawson
2016/0058195 A1 3/2016 Huang et al.
2016/0100687 A1 4/2016 Murphy
2016/0302573 A1 10/2016 Garland et al.
2016/0376007 A1 12/2016 Meindlhumer
2017/0013961 A1 1/2017 LaPointe et al.
2017/0042330 A1 2/2017 Bruce et al.
2017/0101188 A1 4/2017 Auge et al.
2017/0150818 A1 6/2017 Contreras
2017/0367483 A1 12/2017 Fecker et al.
2018/0070725 A1 3/2018 LaPointe et al.
2018/0078039 A1 3/2018 Lapointe et al.
2018/0289156 A1 10/2018 Marshall et al.

(56) References Cited

U.S. PATENT DOCUMENTS

| | | | |
|---|---|---|---|
| 2018/0289157 | A1 | 10/2018 | Marshall et al. |
| 2018/0289158 | A1 | 10/2018 | Marshall et al. |
| 2019/0116981 | A1 | 4/2019 | LaPointe et al. |

FOREIGN PATENT DOCUMENTS

| | | | |
|---|---|---|---|
| EP | 1504697 | A1 | 2/2005 |
| JP | 2001054443 | A | 2/2001 |
| JP | 2003070583 | A | 3/2003 |
| KR | 1020060036132 | | 4/2006 |
| KR | 100807370 | B1 | 2/2008 |
| KR | 101245357 | B1 | 3/2013 |
| WO | WO-9611612 | A1 | 4/1996 |
| WO | WO-2011094478 | A1 | 8/2011 |
| WO | WO-2012162499 | A1 | 11/2012 |
| WO | WO-2015066030 | A1 | 5/2015 |

OTHER PUBLICATIONS

International Search Report and Written Opinion of the International Searching Authority for PCT/2014/019455, dated May 26, 2014.
International Search Report and Written Opinion of the International Searching Authority for PCT/US2017/043899, dated Nov. 8, 2017.
European Search Report for Application No. 19158581.9, dated May 3, 2019.
First Examination Report for New Zealand Application No. 738919, dated Mar. 14, 2019.
International Search Report for Application No. PCT/US2016/021361, dated May 30, 2016.
Written Opinion of the International Searching Authority for Application No. PCT/US2016/021361, dated May 30, 2016.
International Search Report for Application No. PCT/US2016/032967, dated Aug. 19, 2016.
Written Opinion of the International Searching Authority for Application No. PCT/US2016/032967, dated Aug. 19, 2016.
International Search Report for Application No. PCT/US2017/035976, dated Aug. 25, 2017.
Written Opinion of the International Searching Authority for Application No. PCT/US2017/035976, dated Aug. 25, 2017.
International Search Report for Application No. PCT/US2018/025467, dated Jul. 17, 2018.
Written Opinion of the International Searching Authority for Application No. PCT/US2018/025467, dated Jul. 17, 2018.
European Search Report for Application No. 18159817.8, dated Sep. 26, 2018.
European Search Report for Application No. 16824840.9, dated Dec. 7, 2018.
International Search Report for Application No. PCT/US2019/021568, dated Jun. 20, 2019.
Written Opinion of the International Searching Authority for Application No. PCT/US2019/021568, dated Jun. 20, 2019.

* cited by examiner

FURNITURE MEMBER WITH FOLDABLE PAWL AND RATCHET ASSEMBLY

FIELD

The present disclosure relates to a furniture member with a foldable pawl and ratchet assembly.

BACKGROUND

This section provides background information related to the present disclosure and is not necessarily prior art.

Furniture members such as chairs, sofas, loveseats, sectionals, and the like can include a mechanism that allows an occupant of the furniture member to move a legrest panel or platform from a stowed or retracted position to a deployed or extended position to support the legs and/or feet of the occupant. Some furniture members include rocker assemblies that allow for one or more seat assemblies to rock between a rearward-tilt or rocked-back position and a rocked-forward tilt position.

The present disclosure provides a furniture member having rocker assemblies and an extendable legrest. The furniture member of the present disclosure also includes a pawl assembly that locks the seat assembly in a selected tilt position when the occupant moves the legrest toward the extended position. This allows the occupant to select a position of the furniture member that provides optimal comfort for any given occupant on any given occasion.

The pawl assembly of the present disclosure reduces the force required to unlock or release the seat assembly and retract the legrest mechanism to allow the seat assembly to freely rock. The pawl assembly of the present disclosure also reduces the level of noise associated with releasing the seat assembly.

SUMMARY

This section provides a general summary of the disclosure, and is not a comprehensive disclosure of its full scope or all of its features.

The present disclosure provides a furniture member that may include a base frame, a seat assembly, a legrest mechanism, and a pawl assembly. The seat assembly may include a seat frame, a seat bottom, and a seat back. The seat assembly may be movable relative to the base frame between a nominal position and a rearward-tilt position. The seat frame may include a ratchet rack having a plurality of ratchet teeth. The legrest mechanism may be mounted to the seat assembly and is movable relative to the seat assembly between a retracted position and an extended position. The pawl assembly may include a support link, a pawl arm, and an actuation link. The support link is rotatably coupled to the base frame. The pawl arm is rotatably attached to the support link and selectively engages one of the ratchet teeth. The actuation link may be attached to the pawl arm and may be coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack.

In some configurations, an end of the pawl arm engages a tooth of the ratchet rack when the legrest mechanism is in the extended position, and the end of the pawl arm rotates along the tooth of the ratchet rack to disengage the pawl arm from the ratchet rack as the legrest mechanism moves toward the retracted position.

In some configurations, an end of the pawl arm selectively engages one of the ratchet teeth.

In some configurations, the pawl arm includes a first location at which the pawl arm is rotatably attached to the support link and a second location at which the actuation link is rotatably attached to the pawl arm. The first location may be disposed between the second location and the end of the pawl arm.

In some configurations, the pawl assembly includes a first spring rotationally biasing the support link relative to the base frame and a second spring rotationally biasing the pawl arm relative to the support link.

In some configurations, the support link includes a protrusion.

In some configurations, the pawl arm includes a recess.

In some configurations, when the pawl arm is in a first rotational position relative to the support link, a portion of the protrusion is received within the recess and contacts a surface of the pawl arm defining the recess. When the pawl arm is in a second rotational position relative to the support link, the portion of the surface of the protrusion is disposed outside of the recess and is spaced apart from the surface of the pawl arm defining the recess.

In some configurations, the protrusion is formed from a first material, and a body of the support link to which the protrusion is attached is formed from a second material that is different than the first material.

In some configurations, the first material is an elastomeric material or a polymeric material.

In some configurations, the seat assembly is free to rock relative to the base frame between the nominal and rearward-tilt positions when the legrest mechanism is in the retracted position. Engagement between the pawl arm and one of the ratchet teeth restricts rocking relative to the base frame between the nominal and rearward-tilt positions when the legrest mechanism is in the extended position.

In some configurations, the seat frame includes a bracket having a first bracket end and a second bracket end. The ratchet rack includes a first rack end and a second rack end. A pin may extend through apertures in the first bracket end and the first rack end. A tab formed on the second rack end may be received in an aperture formed in the second bracket end.

In some configurations, the pawl arm is rotatable relative to the support link about a first rotational axis; the pawl arm and the actuation link are rotatable relative to each other about a second rotational axis; and the first rotational axis is disposed vertically between the second rotational axis and an end of the pawl arm that engages the ratchet rack.

In some configurations, the ratchet rack is formed from a different material than a material from which at least an end of the pawl arm is formed.

In another form, the present disclosure provides a furniture member that may include a base frame, a seat assembly, a legrest mechanism, and a pawl assembly. The seat assembly may include a seat frame, a seat bottom, and a seat back. The seat assembly may be movable relative to the base frame between a nominal position and a rearward-tilt position. The seat frame may include a ratchet rack having a plurality of ratchet teeth. The legrest mechanism may be mounted to the seat assembly and is movable relative to the seat assembly between a retracted position and an extended position. The pawl assembly may include a support link and a pawl arm. The support link is rotatably coupled to the base frame and includes a protrusion. The pawl arm is rotatably attached to the support link and selectively engages one of the ratchet teeth. The pawl arm is rotatably relative to the support link between a first rotational position in which the protrusion contacts the pawl arm and a second rotational position in which the protrusion is spaced apart from the pawl arm.

In some configurations, an end of the pawl arm engages a tooth of the ratchet rack when the legrest mechanism is in the extended position, and the end of the pawl arm rotates along the tooth of the ratchet rack to disengage the pawl arm from the ratchet rack as the legrest mechanism moves toward the retracted position.

In some configurations, the protrusion is formed from a first material, and a body of the support link to which the protrusion is attached is formed from a second material that is different than the first material.

In some configurations, the pawl assembly includes an actuation link that is attached to the pawl arm and is coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack.

In some configurations, the pawl arm includes a recess.

In some configurations, a portion of the protrusion is received within the recess when the pawl arm is in the first rotational position, and the portion of the protrusion is disposed outside of the recess when the pawl arm is in the second rotational position.

In some configurations, an end of the pawl arm selectively engages one of the ratchet teeth. The pawl arm may include a first location at which the pawl arm is rotatably attached to the support link and a second location at which the actuation link is rotatably attached to the pawl arm. The first location may be disposed between the second location and the end of the pawl arm.

In some configurations, the pawl assembly includes a first spring rotationally biasing the support link relative to the base frame and a second spring rotationally biasing the pawl arm relative to the support link.

In some configurations, the seat assembly is free to rock relative to the base frame between the nominal and rearward-tilt positions when the legrest mechanism is in the retracted position. Engagement between the pawl arm and one of the ratchet teeth restricts rocking relative to the base frame between the nominal and rearward-tilt positions when the legrest mechanism is in the extended position.

In some configurations, the seat frame includes a bracket having a first bracket end and a second bracket end. The ratchet rack includes a first rack end and a second rack end. A pin may extend through apertures in the first bracket end and the first rack end. A tab formed on the second rack end may be received in an aperture formed in the second bracket end.

In some configurations, the pawl assembly includes an actuation link that is attached to the support link and is coupled to the legrest mechanism such that movement of the legrest mechanism into the extended position moves the support link, which moves the pawl arm into engagement with the ratchet rack. Movement of the legrest mechanism toward the retracted position disengages the pawl arm from the ratchet rack.

In some configurations, the ratchet rack is formed from a different material than a material from which at least an end of the pawl arm is formed.

In another form, the present disclosure provides a furniture member that may include a base frame, a seat assembly, a legrest mechanism, and a pawl assembly. The seat assembly may include a seat frame, a seat bottom, and a seat back. The seat assembly may be movable relative to the base frame between a nominal position and a rearward-tilt position. The seat frame may include a ratchet rack having a plurality of ratchet teeth. The legrest mechanism may be mounted to the seat assembly and is movable relative to the seat assembly between a retracted position and an extended position. The pawl assembly may include a support link, a pawl arm, and an actuation link. The support link is rotatably coupled to the base frame. The pawl arm is rotatably attached to the support link and selectively engages one of the ratchet teeth. The actuation link may be attached to the pawl arm and may be coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack. A protrusion may extend from the support link in a direction perpendicular to an axis about which the pawl arm is rotatable relative to the support link. The pawl arm is rotatably relative to the support link between a first rotational position in which the protrusion contacts the pawl arm and a second rotational position in which the protrusion is spaced apart from the pawl arm.

In some configurations, an end of the pawl arm engages a tooth of the ratchet rack when the legrest mechanism is in the extended position, and the end of the pawl arm rotates along the tooth of the ratchet rack to disengage the pawl arm from the ratchet rack as the legrest mechanism moves toward the retracted position.

In some configurations, the seat frame includes a bracket having a first bracket end and a second bracket end. The ratchet rack includes a first rack end and a second rack end. A pin may extend through apertures in the first bracket end and the first rack end. A tab formed on the second rack end may be received in an aperture formed in the second bracket end.

In some configurations, an end of the pawl arm selectively engages one of the ratchet teeth. The pawl arm includes a first location at which the pawl arm is rotatably attached to the support link and a second location at which the actuation link is rotatably attached to the pawl arm. The first location may be disposed between the second location and the end of the pawl arm.

In some configurations, the pawl arm includes a recess.

In some configurations, a portion of the protrusion is received within the recess when the pawl arm is in the first rotational position, and the portion of the protrusion is disposed outside of the recess when the pawl arm is in the second rotational position.

In some configurations, the pawl assembly includes a first spring rotationally biasing the support link relative to the base frame and a second spring rotationally biasing the pawl arm relative to the support link.

In some configurations, the pawl arm is rotatable relative to the support link about a first rotational axis; the pawl arm and the actuation link are rotatable relative to each other about a second rotational axis; and the first rotational axis is disposed vertically between the second rotational axis and an end of the pawl arm that engages the ratchet rack.

In some configurations, the ratchet rack is formed from a different material than a material from which at least an end of the pawl arm is formed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
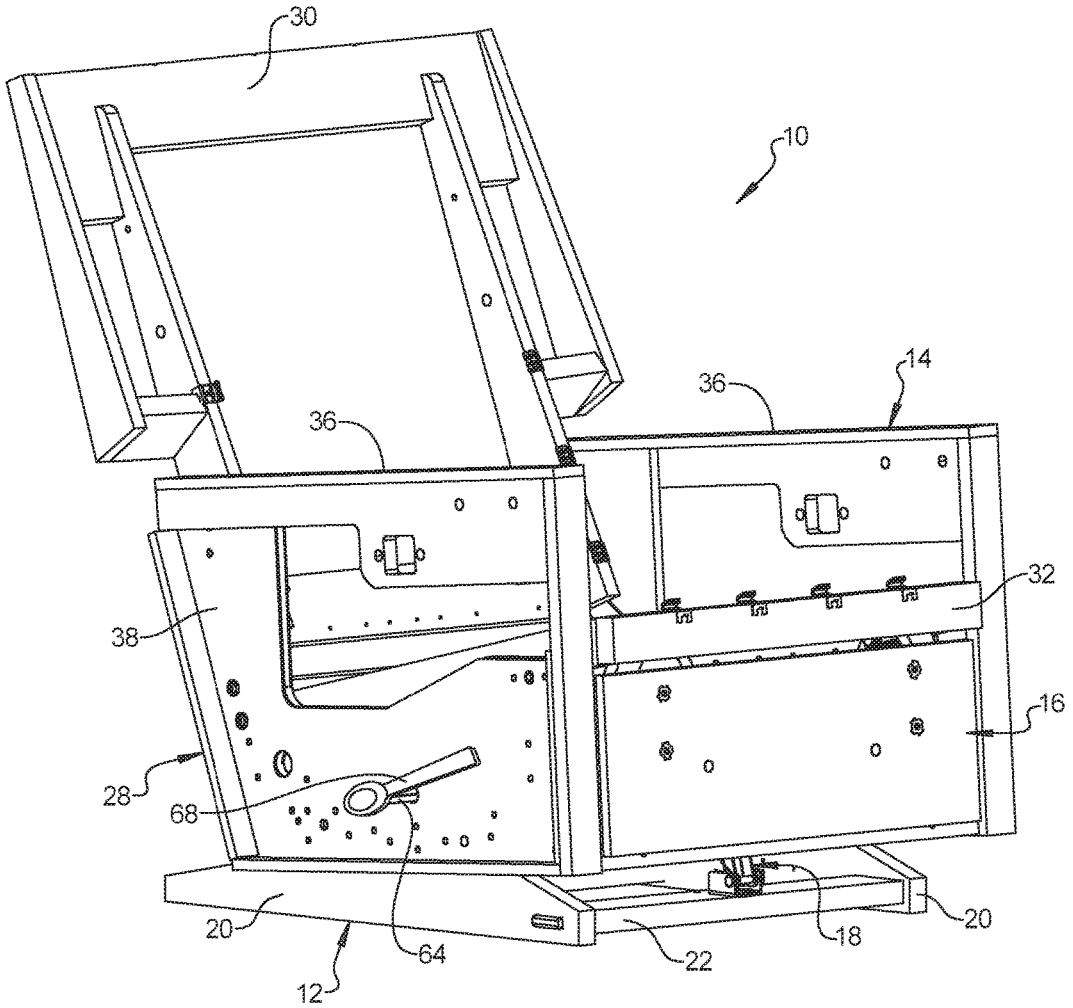
FIG. 1 is a perspective view of a furniture member according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 12:
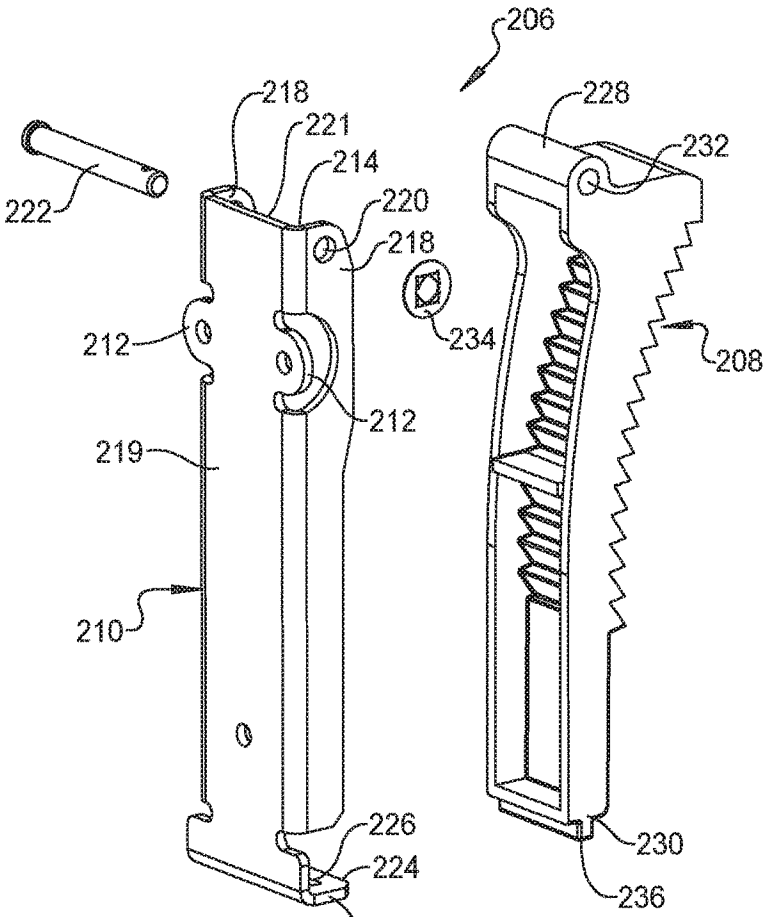
FIG. 12 is an exploded perspective view of the ratchet rack and bracket of FIG. 11.
Figure 13:
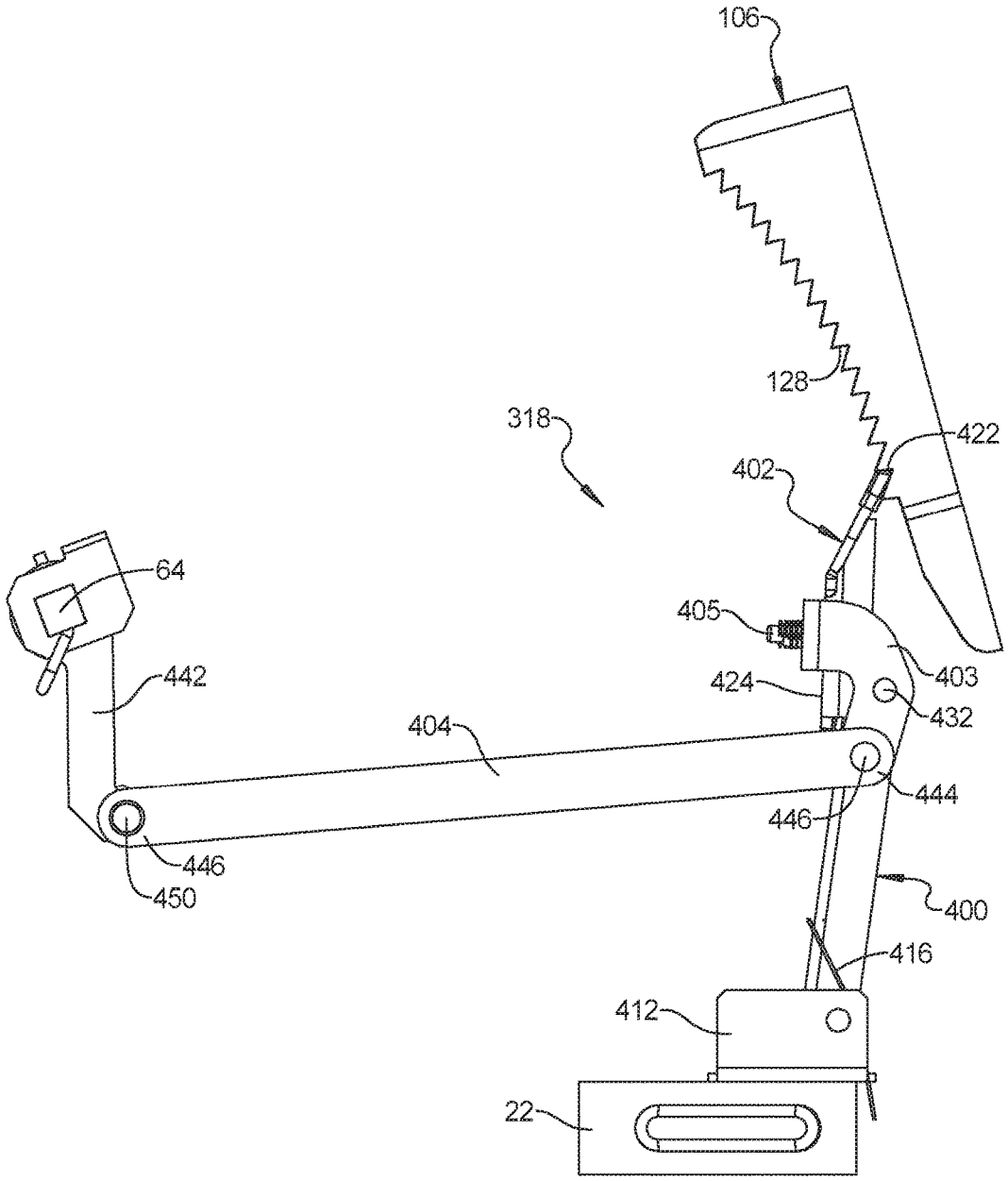
FIG. 13 is a side view of another configuration of a pawl assembly in the engaged position.
Figure 14:
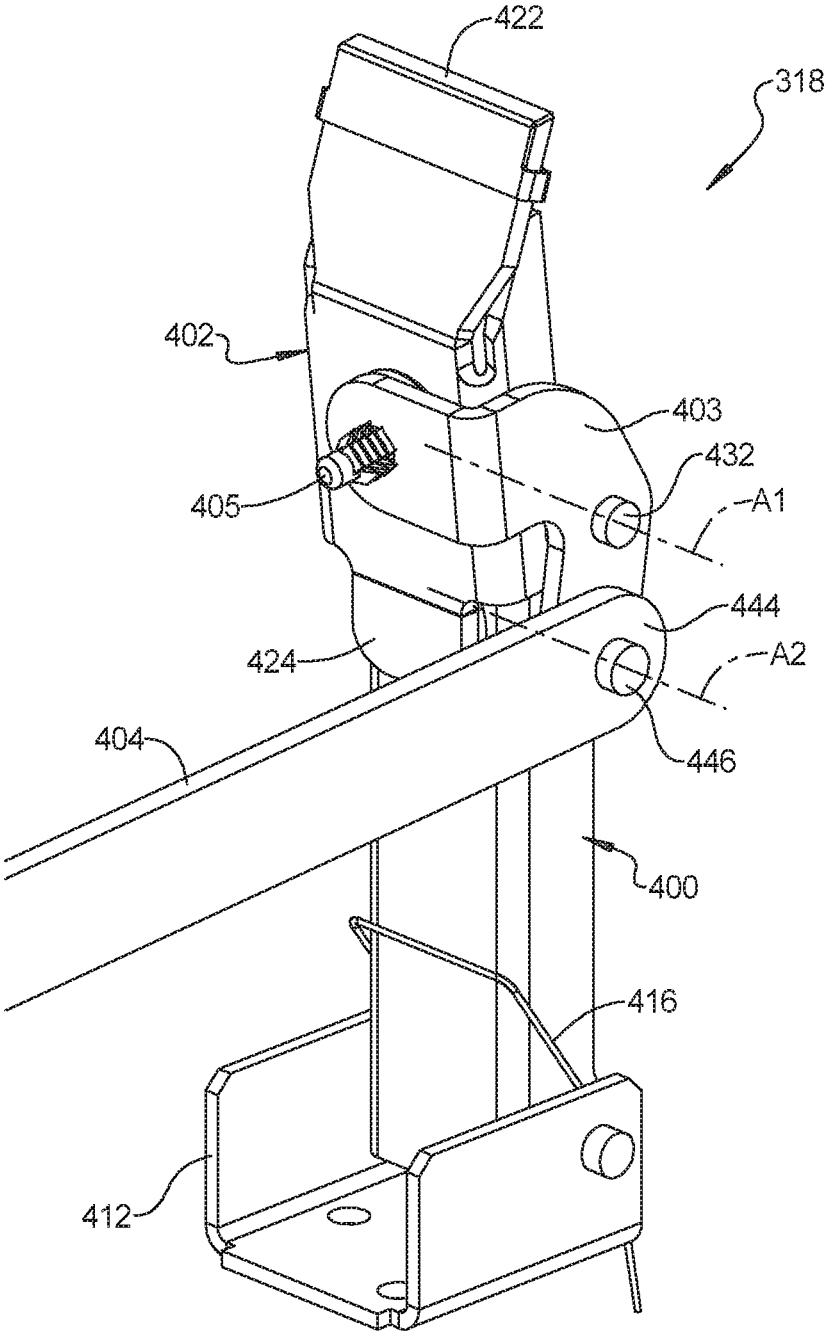
FIG. 14 is a partial perspective view of the pawl assembly in the position of FIG. 13.

With reference to FIGS. 1-10, a furniture member 10 is provided that may include a base frame 12, a seat assembly 14, a legrest mechanism 16, and a foldable pawl assembly 18. As will be described in more detail below, the seat assembly 14 is able to rock relative to the base frame 12 among a nominal position (FIGS. 1 and 2), a rocked-back or rearward-tilt position (FIGS. 3 and 4), and a rocked-forward tilt position (not shown). The legrest mechanism 16 is movable between a retracted position (FIGS. 1 and 2) and an extended position (FIG. 3) while the furniture member 10 is in any of the nominal, rocked-back and rocked-forward tilt positions (and in any tilt position between the rocked-back and rocked-forward tilt positions). As shown in FIGS. 12-14, when the legrest mechanism 16 is moved into the extended position (i.e., a fully extended position or a partially extended position), the pawl assembly 18 locks the seat assembly 14 into a selected tilt position (i.e., the seat assembly 14 is prevented from rocking forward relative to the base frame 12). As the legrest mechanism 16 moves into the retracted position, the pawl assembly 18 releases or unlocks the seat assembly 14 relative to the base frame 12 to allow the seat assembly 14 to rock among the nominal, rocked-back, and rocked-forward tilt positions.

Referring now to FIGS. 1-4, the base frame 12 may include plurality of stationary beams including, for example, a pair of side support members 20 and a pair of cross members 22. The cross members 22 are spaced apart from each other and are attached to and extend between the side support members 20.

Figure 2:
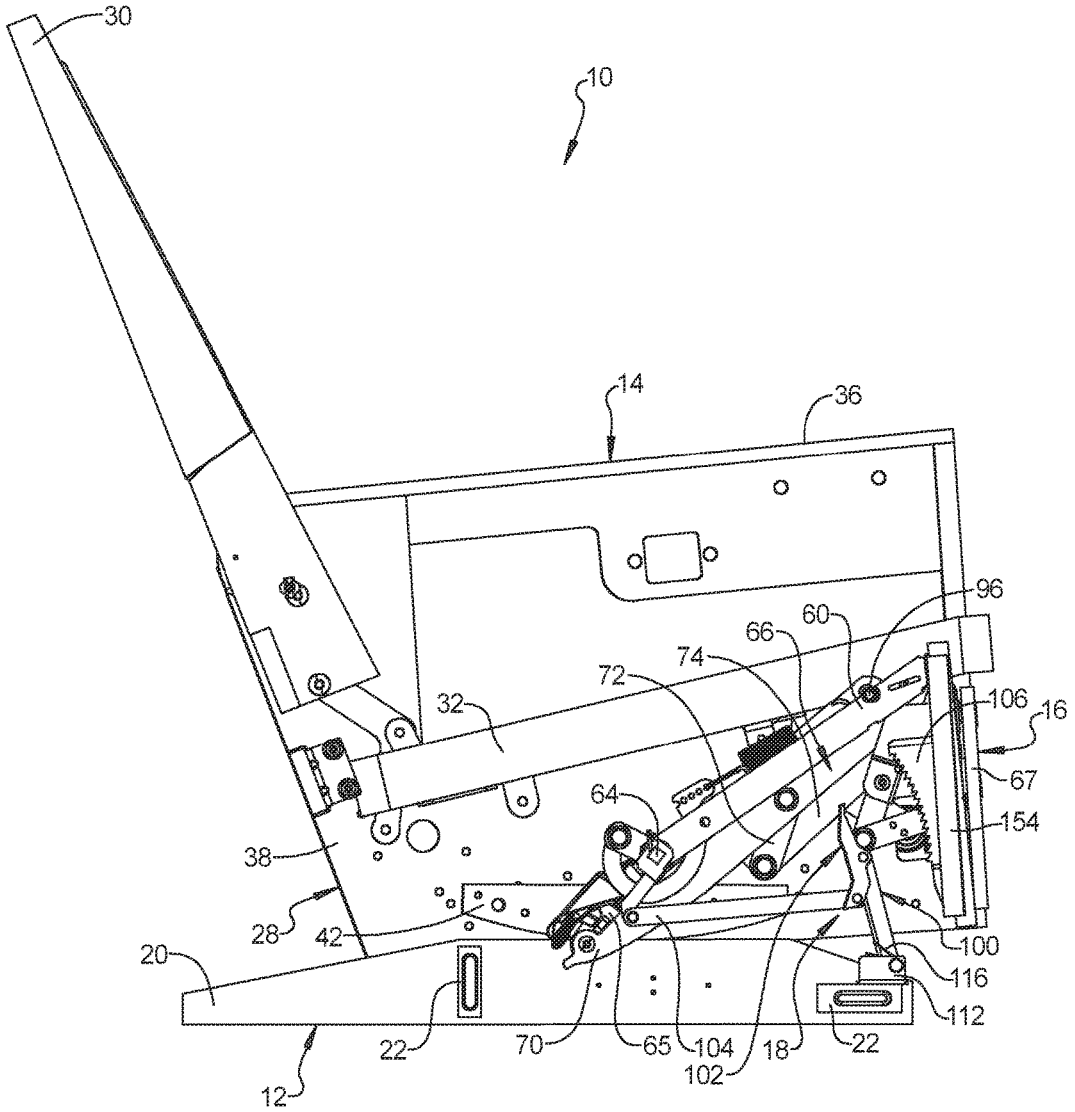
FIG. 2 is a partial side view of the furniture member with a seat assembly in a nominal position, a legrest mechanism in a retracted position, and a pawl assembly in a disengaged position.
Figure 3:
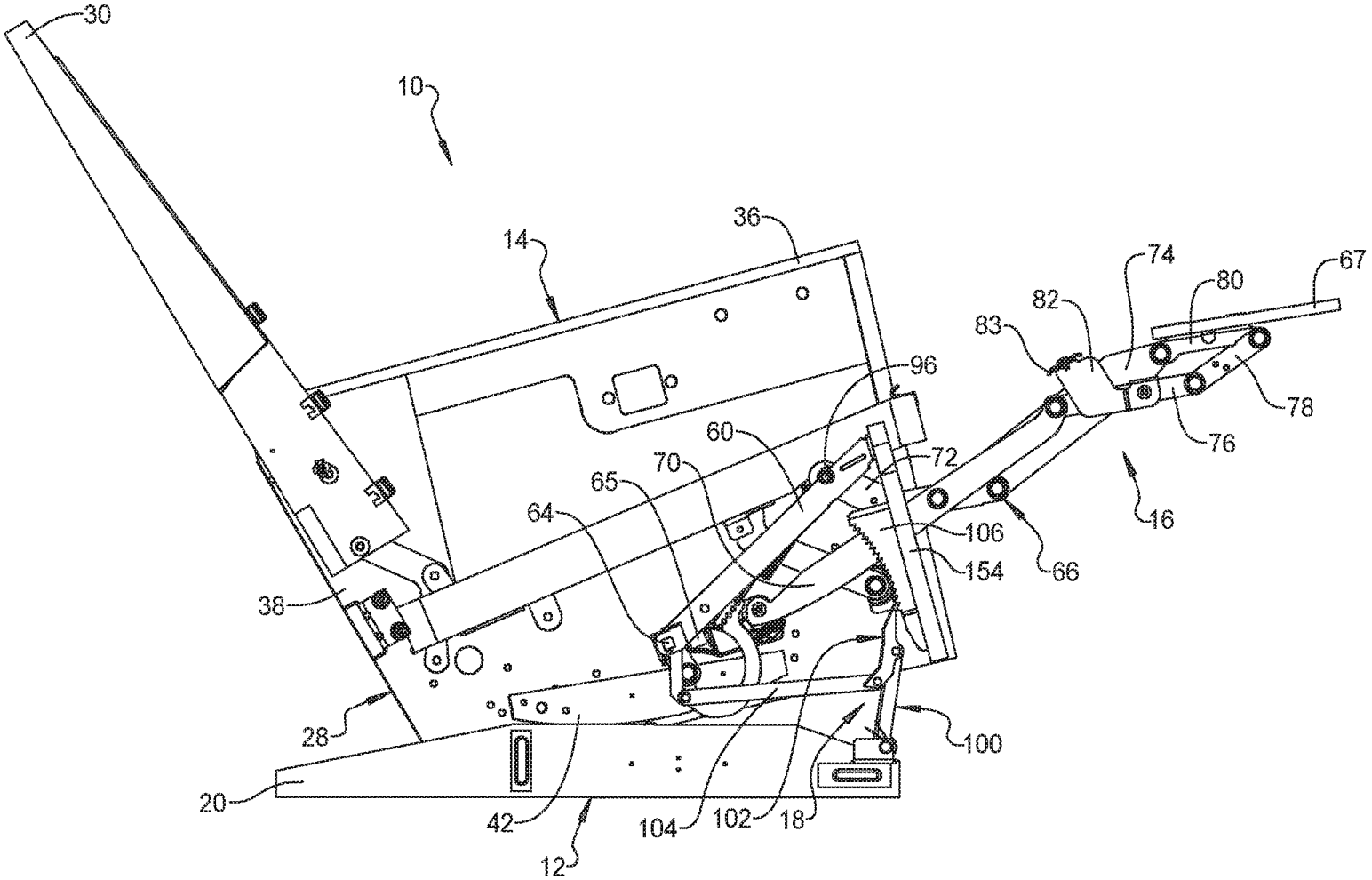
FIG. 3 is a partial side view of the furniture member with the seat assembly in a rearward-tilt or rocked-back position, the legrest mechanism in an extended position, and the pawl assembly in an engaged position.
Figure 4:
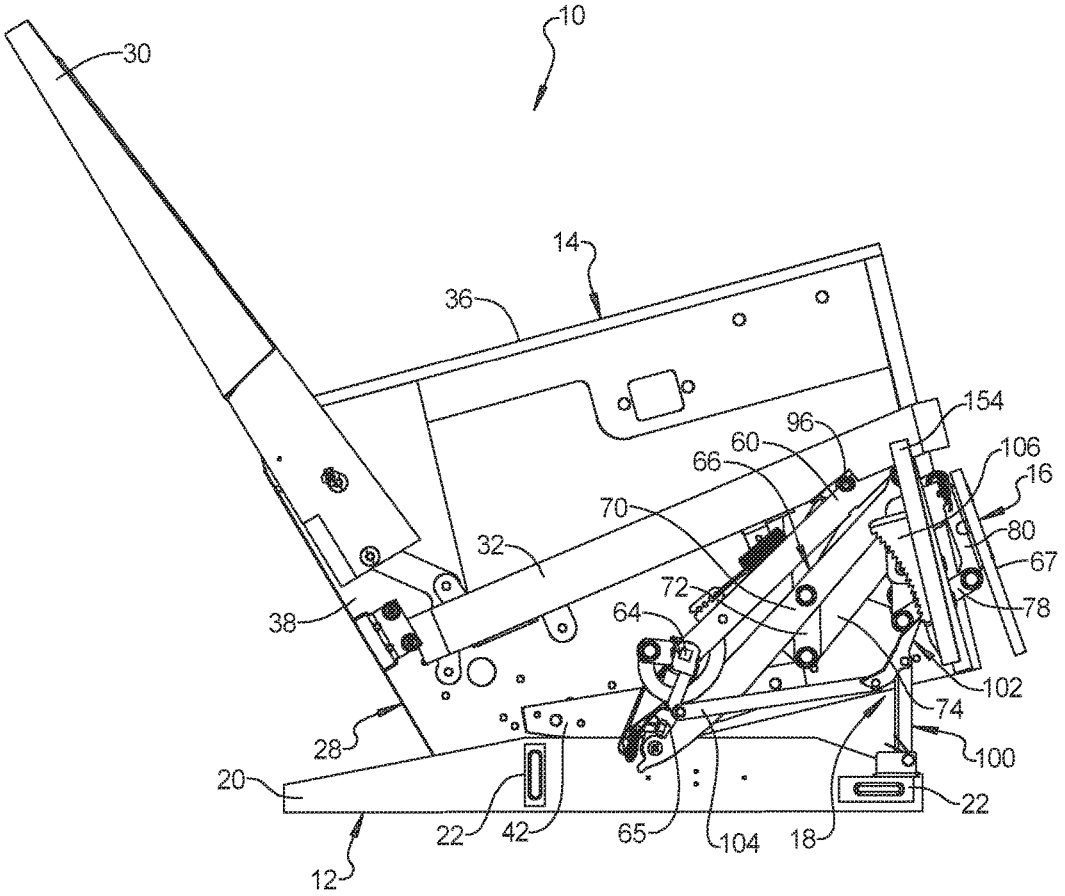
FIG. 4 is a partial side view of the furniture member with the seat assembly in the rearward-tilt position, the legrest mechanism approaching the retracted position, and the pawl assembly releasing from the engaged position.

As shown in FIGS. 1-4, the seat assembly 14 may include a seat frame 28, a seatback 30, and a seat bottom 32. The seat frame 28 may include a plurality of armrests 36 and a seat base 38 that supports the seatback 30, the seat bottom 32 and the legrest mechanism 16. As shown in FIGS. 2-4, a pair of rocker members 42 (only one of which is shown in FIGS. 2-4) may be attached to the seat base 38 and positioned on respective side support members 20 of the base frame 12 to allow the seat assembly 14 to rock relative to the base frame 12 among the nominal, rocked-back and rocked-forward tilt positions.

A pair of springs (not shown) is attached via brackets to each of the rocker members 42 and the corresponding side support members 20. The springs allow the rocker members 42 to rock on the side support members 20 between the rocked-back and rocked-forward tilt positions while biasing the rocker members 42 (and hence, the seat assembly 14) toward the nominal position (FIGS. 1 and 2). The rocker members 42 and springs could have the structure and function of those disclosed in Assignee's U.S. Pat. No. 9,314,101, the disclosure of which is hereby incorporated by reference.

The seatback 30 may be rotatably coupled to the seat base 38 and seat bottom 32 to allow the seatback 30 to rotate relative to the seat frame 28 and the seat bottom 32 between an upright position (e.g., FIGS. 1 and 2) and a reclined position (shown). As the seatback 30 rotates relative to the seat frame 28 from the upright position to the reclined position, the seat bottom 32 may move forward relative to the seat frame 28. As the seatback 30 rotates relative to the seat frame 28 from the reclined position to the upright position, the seat bottom 32 may move rearward relative to the seat frame 28.

As shown in FIGS. 2-4, the legrest mechanism 16 may include a drive rod 64, a pair of pantograph linkages 66 (only one of which is shown in the figures), and a legrest platform 67. The drive rod 64 may have a square or rectangular cross section and may be rotatably supported by bearings mounted to the seat base 38 and a brace member 60. A handle 68 (FIG. 1) is connected to an end of the drive rod 64. Rotation of the handle 68 relative to the seat frame 28 causes corresponding rotation of the drive rod 64 relative to the seat frame 28. The drive rod 64 is rotatably coupled to drive links 65 (FIGS. 2-4; only one of which is shown in the figures) which is rotatably coupled to the pantograph linkages 66 such that rotation of the drive rod 64 causes the pantograph linkages 66 to move between the retracted position (FIGS. 1 and 2) and the extended position (FIG. 3). The legrest platform 67 is attached to and supported by the pantograph linkages 66 such that a user may rest his or her legs and/or feet on the legrest platform 67 while sitting in the furniture member 10 with the legrest mechanism 16 in the extended position.

As shown in FIG. 3, each of the pantograph linkages 66 may include a first support link 70, a swing link 72, a second support link 74, a cross link 76, a third support link 78, a bracket link 80, and a mid-ottoman bracket 82. A first end of the first support link 70 may be rotatably coupled to an end of the drive link 65. A second end of the first support link 70 is rotatably coupled to a first end of the cross link 76. An intermediate portion of the first support link 70 (disposed between the first and second ends of the support link 70) is rotatably coupled to an intermediate portion of the swing link 72.

A first end of the swing link 72 may be rotatably coupled to a support rod 96 that is mounted to the seat frame 28. A second end of the swing link 72 may be rotatably coupled to a first end of the second support link 74. A second end of the second support link 74 is rotatably coupled to a first end of the bracket link 80. An intermediate portion of the second support link 74 is rotatably coupled to an intermediate portion of the cross link 76. A second end of the cross link 76 is rotatably coupled to a first end of the third support link 78. A second end of the third support link 78 is rotatably coupled to a second end of the bracket link 80. The legrest platform 67 may be fixedly attached to the bracket link 80.

As shown in FIG. 3, the mid-ottoman bracket 82 may support a mid-ottoman platform 83 such that the mid-ottoman platform 83 is positioned between the seat bottom 32 and the legrest platform 67 when the legrest mechanism 16 is in the extended position. The mid-ottoman bracket 82 may be fixedly (i.e., non-rotatably) attached to the cross link 76.

As shown in FIGS. 2-7, the pawl assembly 18 may include a support link 100, a pawl arm 102, and an actuation link 104. As will be described in more detail below, the pawl arm 102 engages a ratchet rack 106 when the legrest mechanism 16 is in the extended position to retain the seat assembly 14 at a selected tilt position (e.g., a tilt position between the nominal and rocked-back tilt positions or between the rocked-forward and rocked-back tilt positions) and restrict or prevent the seat assembly 14 from rocking relative to the base frame 12. As the legrest mechanism 16 moves into the retracted position, the pawl arm 102 disengages from the ratchet rack 106 to allow the seat assembly 14 to rock among the nominal, rocked-back, and rocked-forward tilt positions.

As shown in FIGS. 5-9, the support link 100 may be a rigid, elongated body including a first end 108 and a second end 110. The first end 108 may be rotatably mounted to the front one of the cross members 22 of the base frame. For example, a bracket 112 may be fixedly mounted to the cross member 22, and the first end 108 of the support link 100 may be rotatably attached to the bracket 112 by a pin 114. A torsion spring 116 may engage the support link 100 and the bracket 112 and may bias the support link 100 in a first rotational direction (i.e., in a clockwise direction when viewed from the frame of reference of FIG. 2) relative to the cross member 22.

Figure 8:
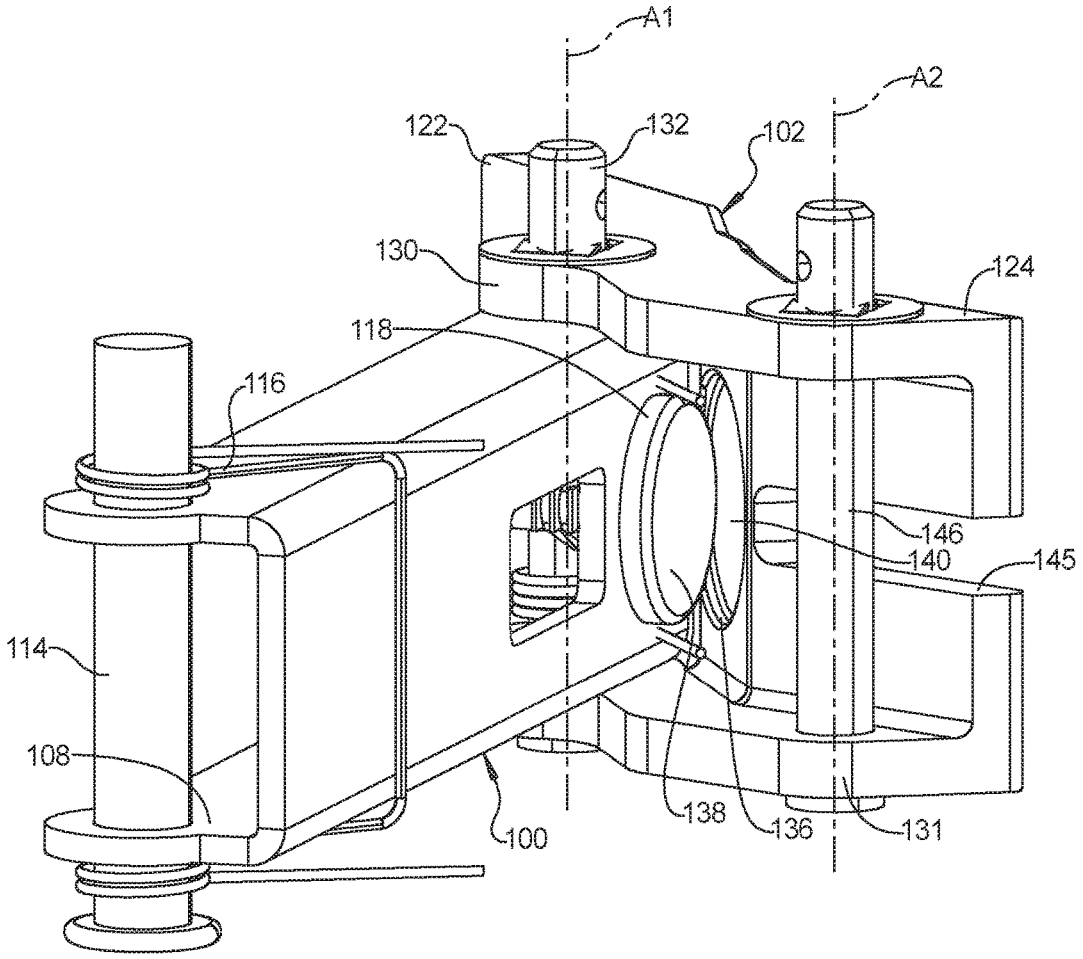
FIG. 8 is a perspective view of a portion of the pawl assembly in the position of FIG. 7.
Figure 9:
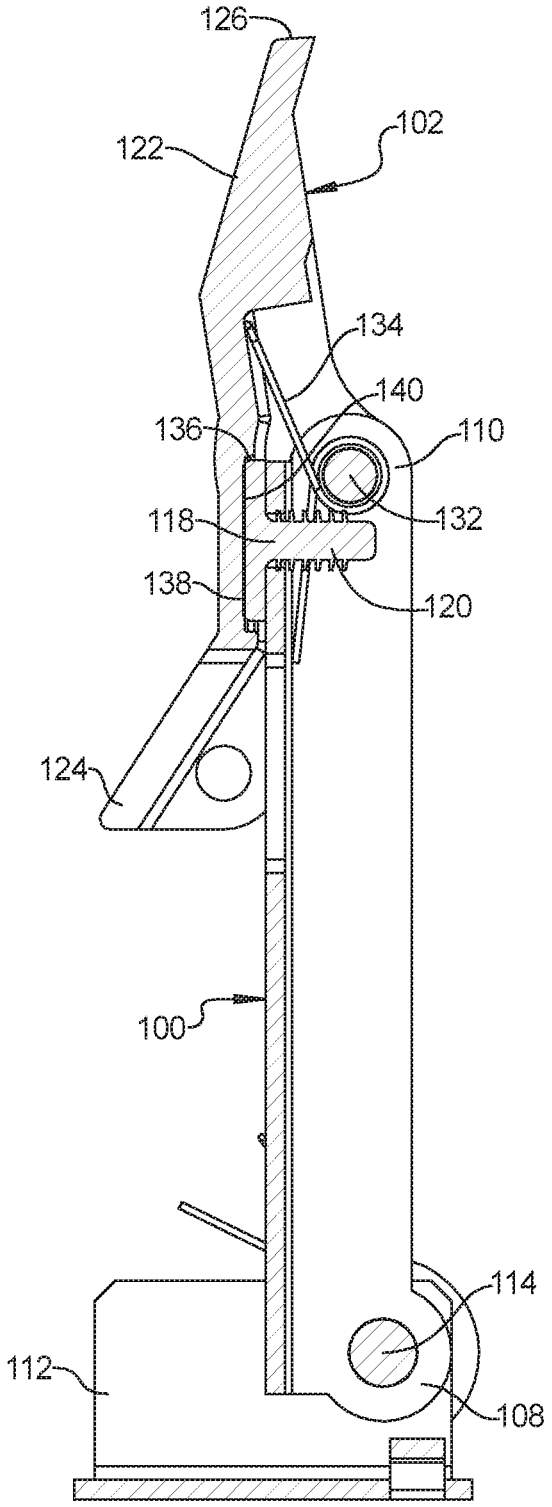
FIG. 9 is a cross-sectional view of a portion of the pawl assembly in the position of FIG. 5.

As shown in FIGS. 8 and 9, a noise damper 118 may be mounted to the body of the support link 100 between the first and second ends 108, 110. The damper 118 may be a generally cylindrical protrusion that is fixedly mounted to the support link 100 via a fastener 120 (e.g., an integrally formed Christmas tree fastener or other barbed or threaded fastener), as shown in FIG. 9. The damper 118 may be formed from a polymeric or elastomeric material (e.g., synthetic or natural rubber or plastic) or any other suitable impact-absorbing and/or sound-deadening material. In some configurations, the body of the support link 100 may be formed from a metallic material or a rigid plastic material. Therefore, the damper 118 may reduce the noise associated with the pawl arm 102 impacting the support link 100.

Figure 5:
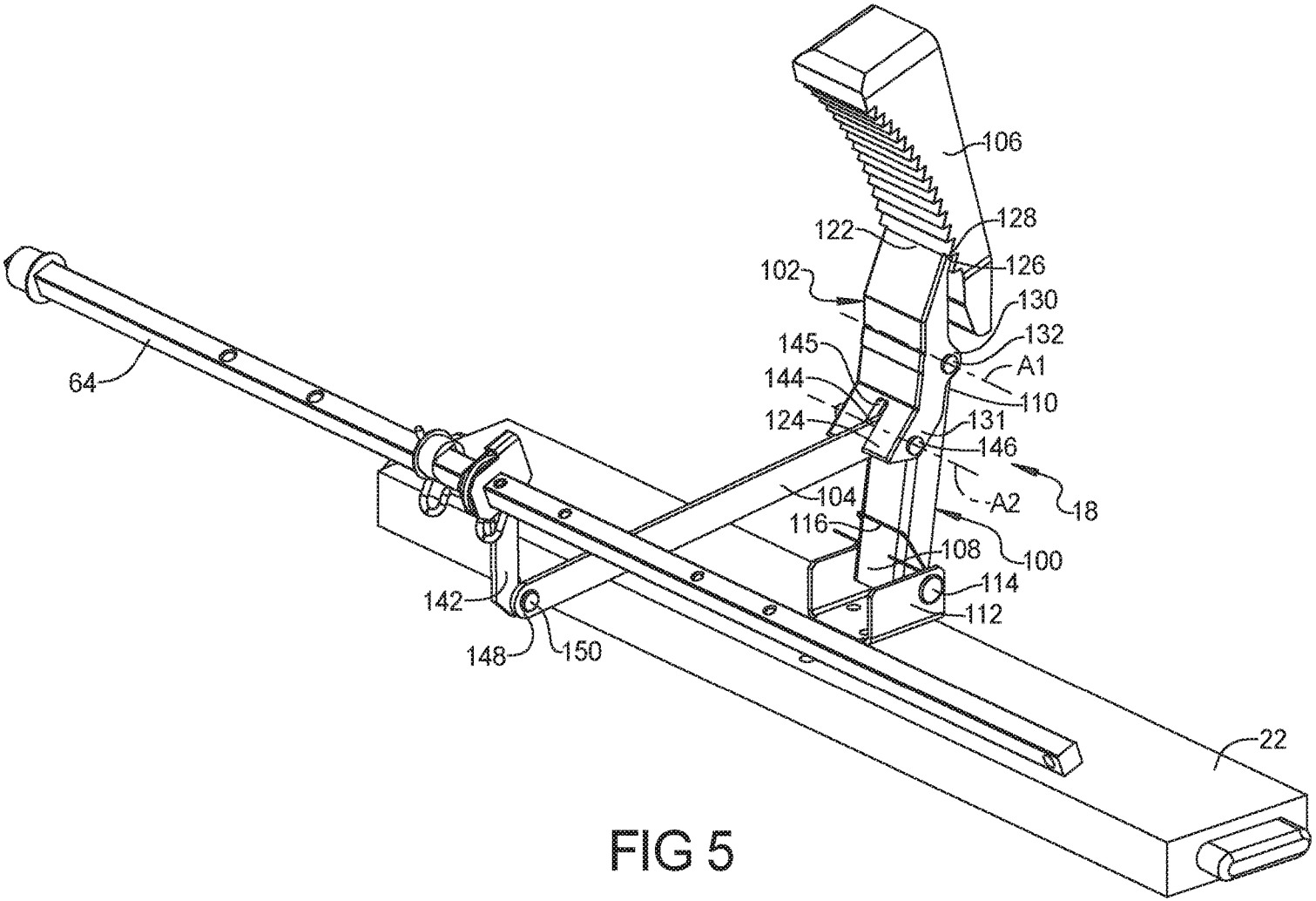
FIG. 5 is a perspective view of a ratchet rack and the pawl assembly in the engaged position.
Figure 6:
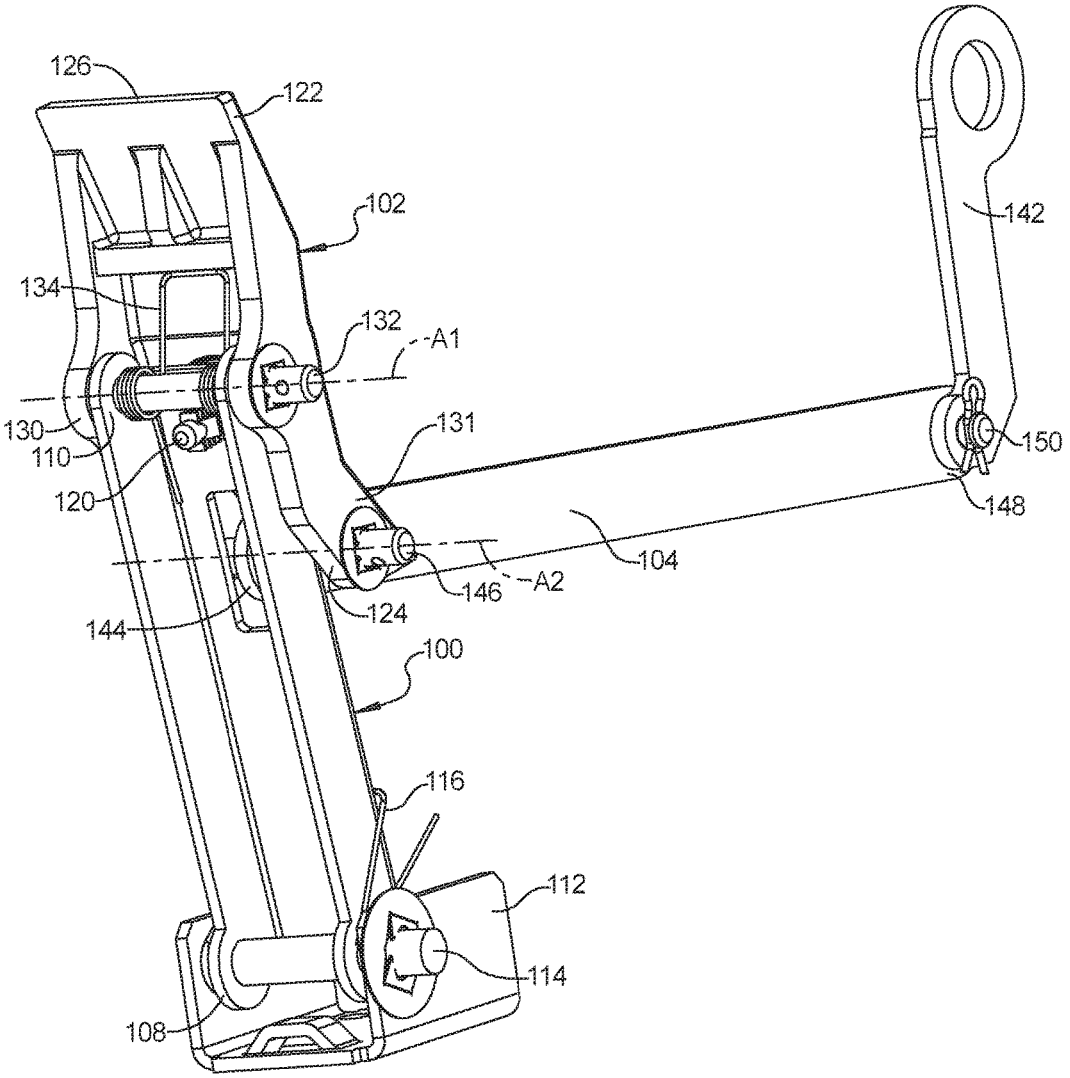
FIG. 6 is a perspective view of the pawl assembly in the position of FIG. 5.
Figure 7:
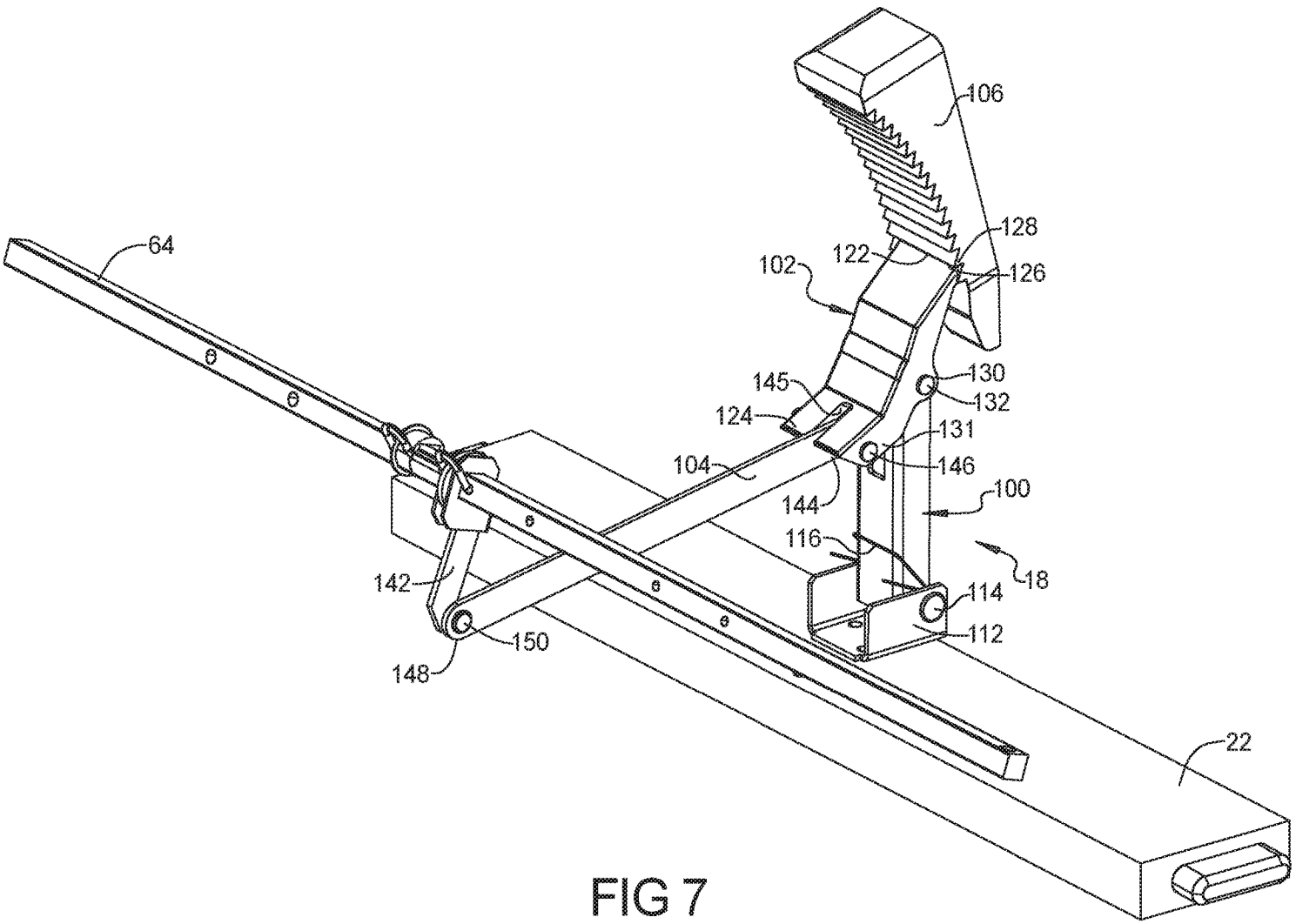
FIG. 7 is a perspective view of the ratchet rack and the pawl assembly releasing from the engaged position.

As shown in FIGS. 5-9, the pawl arm 102 may be a rigid body including a first end 122 and a second end 124. The first end 122 includes an edge 126 that is sized to engage a selected one of a plurality of ratchet teeth 128 of the ratchet rack 106, as shown in FIGS. 5 and 7. The pawl arm 102 may be rotatably coupled to the support link 100 at a first location 130 that is between the first and second ends 122, 124. For example, a pin 132 may extend through the second end 110 of the support link 100 and through the first location 130 of the pawl arm 102 to connect the pawl arm 102 to the support link 100 for relative rotation therebetween. In this manner, the pawl arm 102 is rotatable relative to the support link 100 between a first rotational position (FIGS. 2, 3, 5, and 6) and a second rotational position (FIGS. 4, 7, and 8). A torsion spring 134 (FIGS. 6 and 9) may engage the support link 100 and the pawl arm 102 and may rotationally bias the pawl arm 102 relative to the support link 100 in a second rotational direction (i.e., in counterclockwise direction when viewed from the frame of reference of FIG. 2) toward the first rotational position.

As shown in FIGS. 8 and 9, the pawl arm 102 may include a generally cylindrical recess 136 formed therein. The recess 136 may be sized to receive at least a portion of the damper 118 on the support link 100 when the pawl arm 102 is in the first rotational position. An axial end surface 138 of the damper 118 may contact a surface 140 of the pawl arm 102 (i.e., an axial end surface that defines an axial end of the recess 136), as shown in FIG. 9. As shown in FIG. 8, when the pawl arm 102 is in the second rotational position relative to the support link 100, the axial end surfaces 138, 140 are spaced apart from each other, and the damper 118 may be disposed outside of the recess 136.

As shown in FIGS. 5-7, the actuation link 104 may be rotatably coupled to the pawl arm 102 and to a crank link 142. That is, a first end 144 of the actuation link 104 may extend through a slot 145 and may be rotatably coupled to a second location 131 on the pawl arm 102 via a pin 146. A second end 148 of the actuation link 104 is rotatably coupled to the crank link 142 via a pin 150. The crank link 142 is rotationally fixed to the drive rod 64.

The second location 131 on the pawl arm 102 may be disposed at or near the second end 124 of the pawl arm 102. The first location 130 on the pawl arm 102 (i.e., the location at which the pawl arm 102 is rotatably connected to the support link 100) is disposed between the second location 131 and the first end 122 of the pawl arm 102. That is, as shown in FIGS. 5 and 6, a first rotational axis A1 (i.e., a rotational axis defined by the pin 132 about which the pawl arm 102 is rotatably relative to the support link 100) is disposed between the first end 122 and a second rotational axis A2 (i.e., a rotational axes defined by pin 146 about which the pawl arm 102 and the actuation link 104 are rotatable relative to each other). Having the actuation link 104 rotationally connected to the pawl arm 102 and positioning the first rotational axis A1 between the first end 122 and the second rotational axis A2 such that the second rotational axis is disposed vertically below the first rotational axis A1 reduces the amount of force required to rotate the pawl arm 102 to disengage the pawl arm 102 from the ratchet rack 106, which reduces the amount of force that the user must exert to rotate the handle 68 to release the seat assembly 14 from a selected tilt position and move the legrest mechanism 16 toward the retracted position. This positioning also provides for smoother (i.e., less jarring) disengagement between the pawl arm 102 and the ratchet rack 106. That is, the actuation link 104 pulling directly on the pawl arm 102 and the relative positioning of the first and second rotational axes A1, A2 described above results in a more gradually release of the energy stored in the rocker springs when the pawl arm 102 disengages from the pawl rack 106. Furthermore, the rotating motion of the pawl arm 102 relative to the ratchet rack 106 (i.e., the end 122 of the pawl arm 102 rotating along and in contact with one of the teeth 128 of the ratchet rack 106) as the pawl arm 102 moves towards disengagement from the ratchet rack 106 helps to more gradually release energy stored in the rocker springs when the pawl arm 102 disengages from the pawl rack 106.

The relative positioning of the first and second rotational axes A1, A2 also slows the snapping back of the pawl arm 102 relative to the support link 100. That is, after the pawl arm 102 disengages the ratchet rack 106, the spring 134 will rotationally urge the pawl arm 102 and support link 100 relative to each other toward a position in which the damper 118 is in contact with the pawl arm 102 (e.g., such that the damper 118 is received inside of the recess 136). The relative positioning of the first and second rotational axes A1, A2 described above slows that relative rotational movement between the pawl arm 102 and the support link 100 after the pawl arm 102 disengages the ratchet rack 106 to reduce the noise generated when the pawl arm 102 impacts the damper 118.

The ratchet rack 106 shown in FIGS. 2-5 and 10 may be a unitary body molded and/or otherwise formed from a polymeric material, for example. The ratchet rack 106 may include a plurality of threaded apertures 152 (FIG. 10) that may receive threaded fasteners (not shown) that fixedly attach the ratchet rack 106 to a front panel 154 (FIGS. 2-4) of the seat base 38 of the seat assembly 14.

Figure 11:
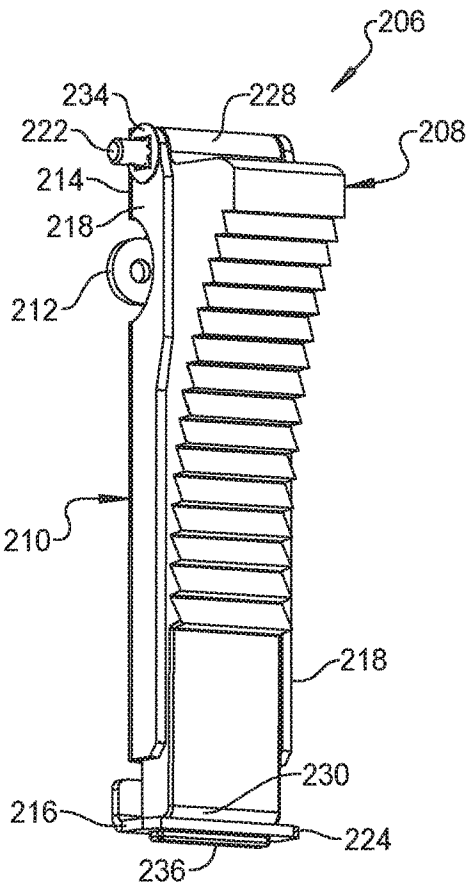
FIG. 11 is a perspective view of another configuration of a ratchet rack and a bracket that can be incorporated into the furniture member of FIG. 1.
Figure 10:
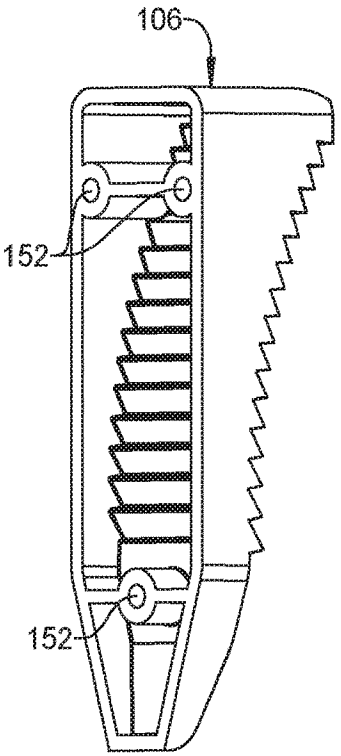
FIG. 10 is a perspective view of the ratchet rack.

FIGS. 11 and 12 depict a ratchet rack assembly 206 that can be incorporated into the furniture member 10 instead of the ratchet rack 106. The ratchet rack assembly 206 may include a ratchet rack 208 and a bracket 210. The bracket 210 can be fixedly attached to the front panel 154 of the seat base 38 by a plurality of threaded fasteners (not shown), for example, that may extend through apertures in tabs 212. The bracket 210 may include a first bracket end 214 and a second bracket end 216. Sidewalls 218 extend from the first bracket end 214 toward the second bracket end 216. The sidewalls 218 cooperate with a base 219 of the bracket 210 to define a channel 221 in which the ratchet rack 208 may be at least partially received. Each of the sidewalls 218 may include an aperture 220 (FIG. 12) disposed at or near the first bracket end 214. The apertures 220 are sized and shaped to slidably receive a pin (e.g., a non-threaded pin) 222. The second bracket end 216 may include a tab 224 having a generally rectangular aperture 226.

The ratchet rack 208 may include a first rack end 228 and a second rack end 230. The first rack end 228 may include an aperture 232 that is sized and shaped to receive the pin 222 such that when the aperture 232 is aligned with the apertures 220, the pin 222 can be inserted through the apertures 220, 232, as shown in FIG. 11. A cap nut or a push nut 234 may be pressed onto the end of the pin 222 to prevent the pin 222 from unintentionally sliding out of the apertures 220, 232. The second rack end 230 may include a tab 236 that is received in the aperture 226 in the second bracket end 224 prior to inserting the pin 222 through the apertures 220, 232. The construction of the ratchet rack assembly 206 described above allows for the ratchet rack 208 to be quickly attached to and removed from the seat base 38 (e.g., for assembling, repairing or replacing the ratchet rack 208). In some configurations, the bracket 210 may be formed from a metallic material and the ratchet rack 208 may be formed from a polymeric or elastomeric material. The polymeric or elastomeric material of the ratchet rack 208 can reduce the noise associated with contact and friction between the pawl arm 102 and the ratchet rack 206.

Referring now to FIGS. 13-18, another pawl assembly 318 is provided that may be incorporated into the furniture member 10 instead of the pawl assembly 18. The structure and function of the pawl assembly 318 may be similar or identical to that of the pawl assembly 18, apart from any differences described below and/or shown in the figures. Therefore, similar features may not be described again in detail.

Like the pawl assembly 18, the pawl assembly 318 may include a support link 400, a pawl arm 402, and an actuation link 404. As with the pawl assembly 18, the pawl arm 402 engages the ratchet rack 106 (or the ratchet 208) when the legrest mechanism 16 is in the extended position to retain the seat assembly 14 at a selected tilt position and restrict or prevent the seat assembly 14 from rocking relative to the base frame 12. As the legrest mechanism 16 moves into the retracted position, the pawl arm 402 disengages from the ratchet rack 106 (or the ratchet 208) to allow the seat assembly 14 to rock among the nominal, rocked-back, and rocked-forward tilt positions.

Figure 16:
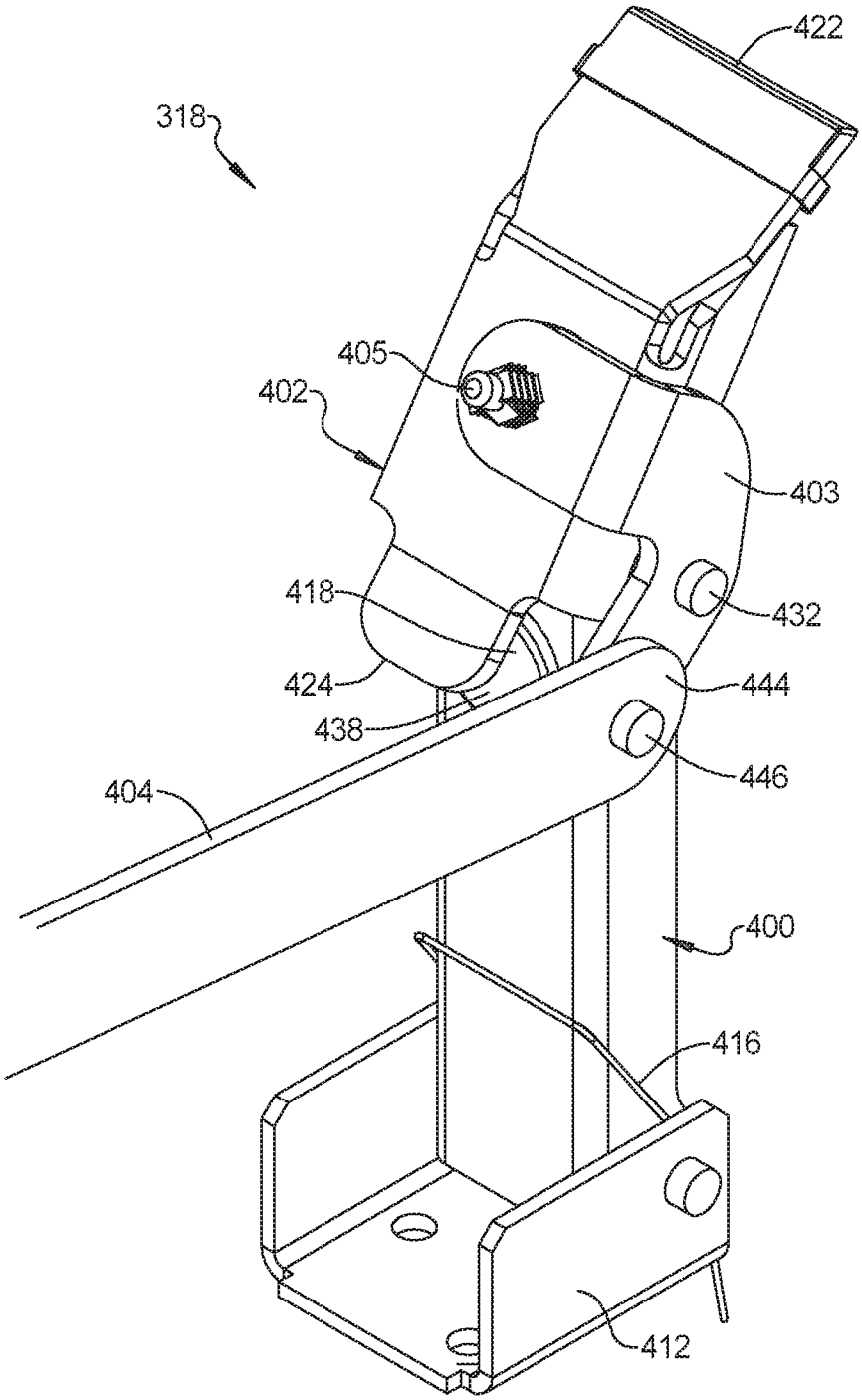
FIG. 16 is a partial perspective view of the pawl assembly in the position of FIG. 15.
Figure 17:
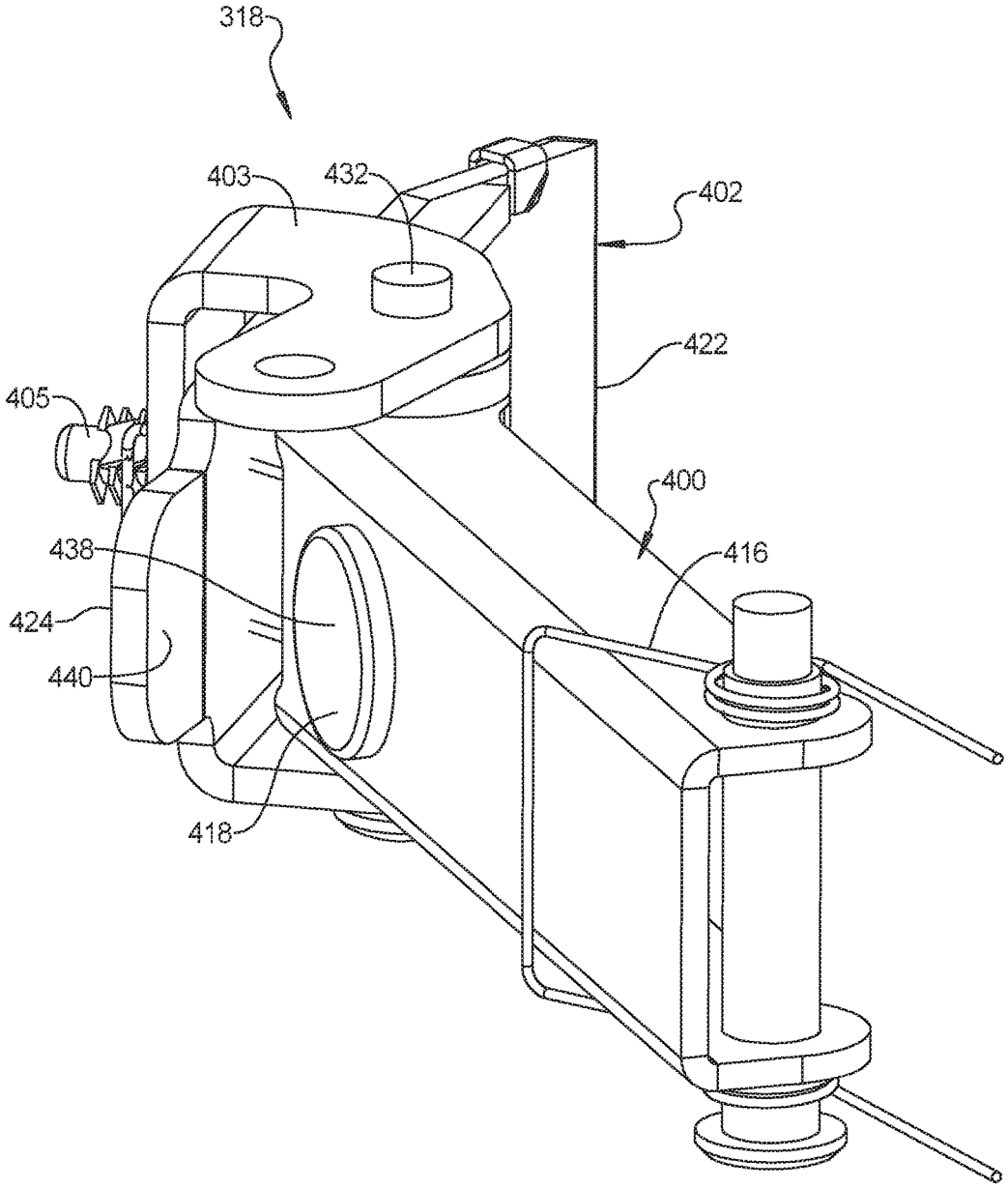
FIG. 17 is a perspective view of a portion of the pawl assembly in the position of FIG. 15.
Figure 18:
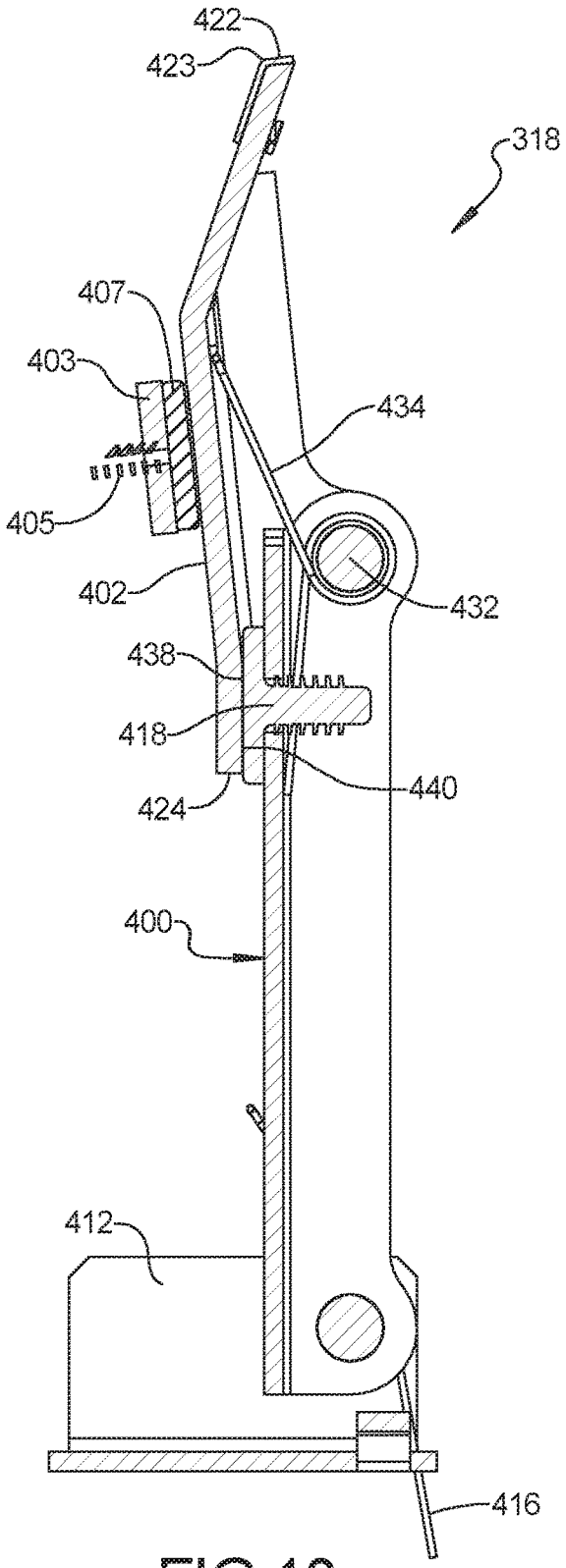
FIG. 18 is a cross-sectional view of a portion of the pawl assembly in the position of FIG. 13.

The support link 400 may be similar or identical to the support link 100 described above. Like the support link 100, the support link 400 is rotatably attached to a bracket 412. A torsion spring 416 may engage the support link 400 and the bracket 412 and may bias the support link 400 in a first rotational direction (i.e., in a clockwise direction when viewed from the frame of reference of FIG. 13) relative to the cross member 22. As shown in FIGS. 16-18, the support link 400 may also include a noise damper 418 (similar or identical to damper 118).

The pawl arm 402 may be a rigid body including a first end 422 and a second end 424. The first end 422 includes an edge that is sized to engage a selected one of a plurality of ratchet teeth 128 of the ratchet rack 106, as shown in FIG. 13. In some configurations, the first end 422 may include a cap or sleeve 423 (shown in FIG. 18) that is formed from a different material (e.g., a polymeric or elastomeric material) than the rest of the pawl arm 402. The cap or sleeve 423 can reduce the noise associated with engagement and friction between the pawl arm 402 and the ratchet rack 106.

Figure 15:
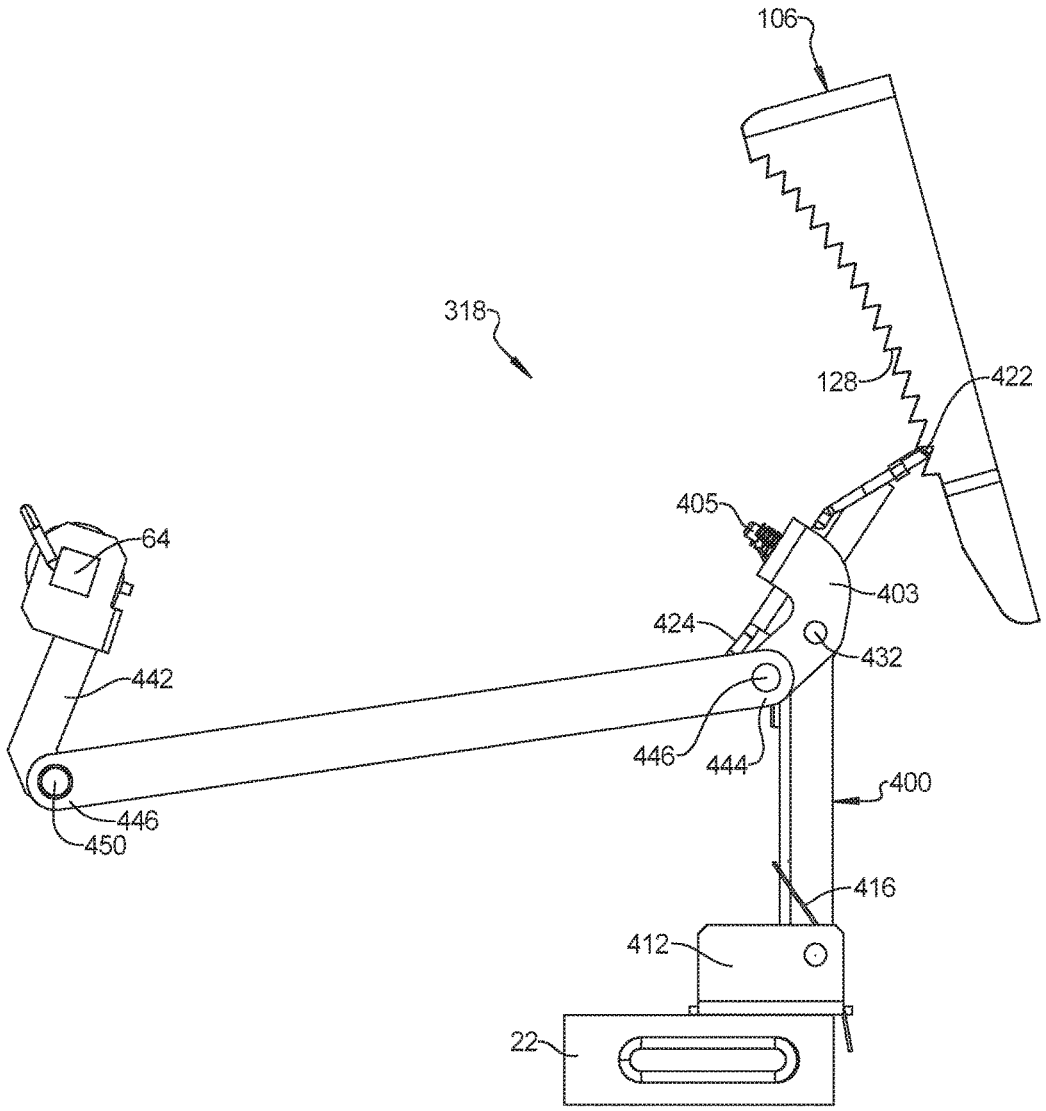
FIG. 15 is a side view of the pawl assembly of FIG. 13 releasing from the engaged position.

The pawl arm 402 may include a connecting arm 403 that extends from a portion of the pawl arm 402 disposed between the first and second ends 422, 424. A first end of the connecting arm 403 may be attached to the pawl arm 402 by a barbed fastener 405 (e.g., a Christmas tree fastener). In some configurations, an elastomeric damper 407 may be sandwiched between the pawl arm 402 and the first end of the connecting arm 403. An intermediate portion of the connecting arm 403 may be rotatably coupled to the support link 400. For example, a pin 432 may extend through an end of the support link 400 and through the intermediate portion of the connecting arm 403 to connect the pawl arm 402 to the support link 400 for relative rotation therebetween. In this manner, the pawl arm 402 is rotatable relative to the support link 400 between a first rotational position (FIGS. 13, 14 and 18) and a second rotational position (FIGS. 15-17). A torsion spring 434 (FIG. 18) may engage the support link 400 and the pawl arm 402 and may rotationally bias the pawl arm 402 relative to the support link 400 in a second rotational direction (i.e., in counterclockwise direction when viewed from the frame of reference of FIG. 18) toward the first rotational position.

As shown in FIG. 18, an axial end surface 438 of the damper 418 may contact a surface 440 of the second end 424 of the pawl arm 402. As shown in FIGS. 16 and 17, when the pawl arm 402 is in the second rotational position relative to the support link 400, the damper 418 is spaced apart from the surface 440.

As shown in FIGS. 13-15, the actuation link 404 may be rotatably coupled to a second end of the connecting arm 403 and to a crank link 442 (similar or identical to crank link 142). That is, a first end 444 of the actuation link 404 may be rotatably coupled to second end of the connecting arm 403 via a pin 446. A second end 448 of the actuation link 404 is rotatably coupled to the crank link 442 via a pin 450. The crank link 442 is rotationally fixed to the drive rod 64.

As shown in FIG. 14, a first rotational axis A1 (i.e., a rotational axis defined by the pin 432 about which the pawl arm 402 is rotatably relative to the support link 400) is disposed between the first end 422 and a second rotational axis A2 (i.e., a rotational axes defined by pin 446 about which the pawl arm 402 and the actuation link 404 are rotatable relative to each other). Having the actuation link 404 rotationally connected to the pawl arm 402 and positioning the first rotational axis A1 between the first end 422 and the second rotational axis A2 such that the second rotational axis A2 is disposed vertically below the first rotational axis A1 reduces the amount of force required to rotate the pawl arm 402 to disengage the pawl arm 402 from the ratchet rack 106, which reduces the amount of force that the user must exert to rotate the handle 68 to release the seat assembly 14 from a selected tilt position and move the legrest mechanism 16 toward the retracted position. This positioning also provides for smoother (i.e., less jarring) disengagement between the pawl arm 402 and the ratchet rack 106. That is, the actuation link 404 pulling on the pawl arm 402 and the relative positioning of the first and second rotational axes A1, A2 described above results in a more gradually release of the energy stored in the rocker springs when the pawl arm 402 disengages from the pawl rack 106, 208. Furthermore, as described above, the rotating motion of the pawl arm 402 relative to the ratchet rack 106, 208 (i.e., the end 422 of the pawl arm 402 rotating along and in contact with one of the teeth 128 of the ratchet rack 106, 208) as the pawl arm 402 moves towards disengagement from the ratchet rack 106, 208 helps to more gradually release energy stored in the rocker springs when the pawl arm 402 disengages from the ratchet rack 106, 208.

The relative positioning of the first and second rotational axes A1, A2 also slows the snapping back of the pawl arm 402 relative to the support link 400. That is, after the pawl arm 402 disengages the ratchet rack 106, the spring 434 will rotationally urge the pawl arm 402 and support link 400 relative to each other toward a position in which the damper 418 is in contact with the pawl arm 402. The relative positioning of the first and second rotational axes A1, A2 described above slows that relative rotational movement between the pawl arm 402 and the support link 400 after the pawl arm 402 disengages the ratchet rack 106 to reduce the noise generated when the pawl arm 402 impacts the damper 418.

Referring now to FIGS. 19-24, another pawl assembly 518 is provided that may be incorporated into the furniture member 10 instead of the pawl assembly 18. The structure and function of the pawl assembly 518 may be similar or identical to that of the pawl assembly 18, 318, apart from any differences described below and/or shown in the figures. Therefore, similar features may not be described again in detail.

Like the pawl assemblies 18, 318, the pawl assembly 518 may include a support link 600, a pawl arm 602, and an actuation link 604. As with the pawl assemblies 18, 318, the pawl arm 602 engages the ratchet rack 106 (or the ratchet 208) when the legrest mechanism 16 is in the extended position to retain the seat assembly 14 at a selected tilt position and restrict or prevent the seat assembly 14 from rocking relative to the base frame 12. As the legrest mechanism 16 moves into the retracted position, the pawl arm 602 disengages from the ratchet rack 106 (or the ratchet 208) to allow the seat assembly 14 to rock among the nominal, rocked-back, and rocked-forward tilt positions.

Figure 23:
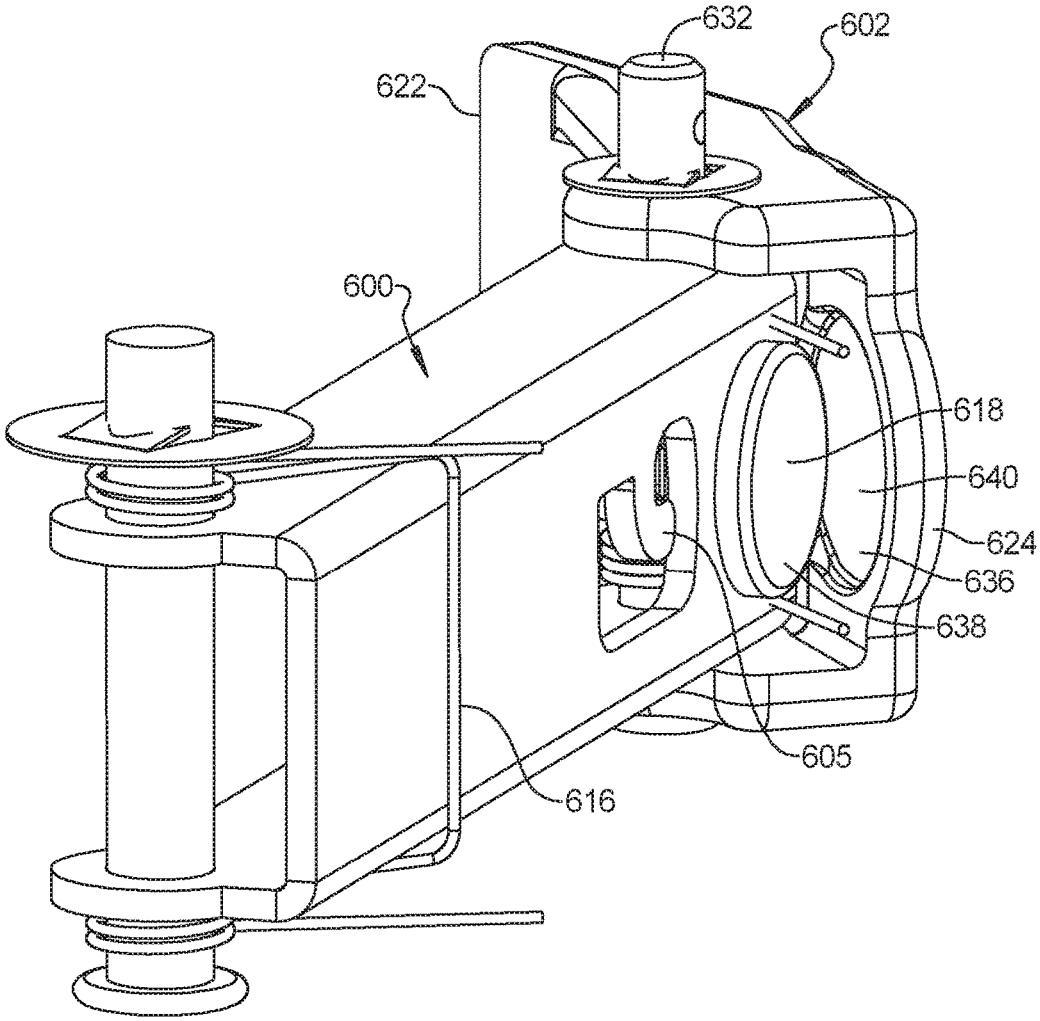
FIG. 23 is a perspective view of a portion of the pawl assembly in the position of FIG. 21.
Figure 24:
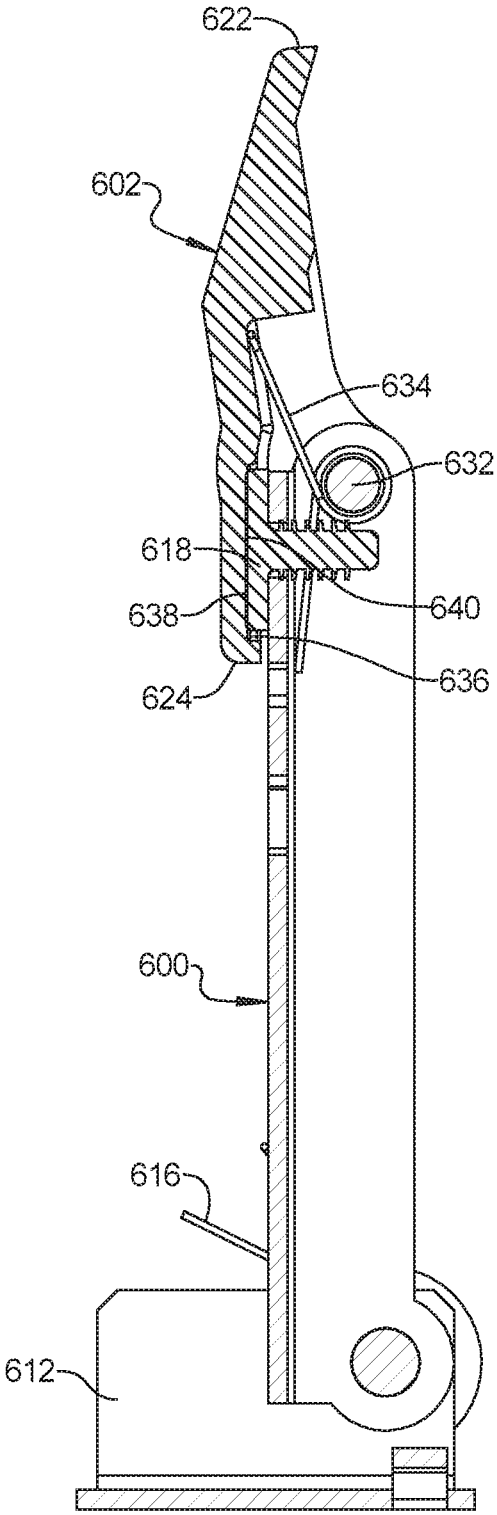
FIG. 24 is a cross-sectional view of a portion of the pawl assembly in the position of FIG. 19.

Like the support link 100, the support link 600 is rotatably attached to a bracket 612 mounted to the cross member 22. A torsion spring 616 may engage the support link 600 and the bracket 612 and may bias the support link 600 in a first rotational direction (i.e., in a clockwise direction when viewed from the frame of reference of FIG. 19) relative to the cross member 22. As shown in FIGS. 23 and 24, the support link 600 may also include a noise damper 618 (similar or identical to damper 118).

Figure 19:
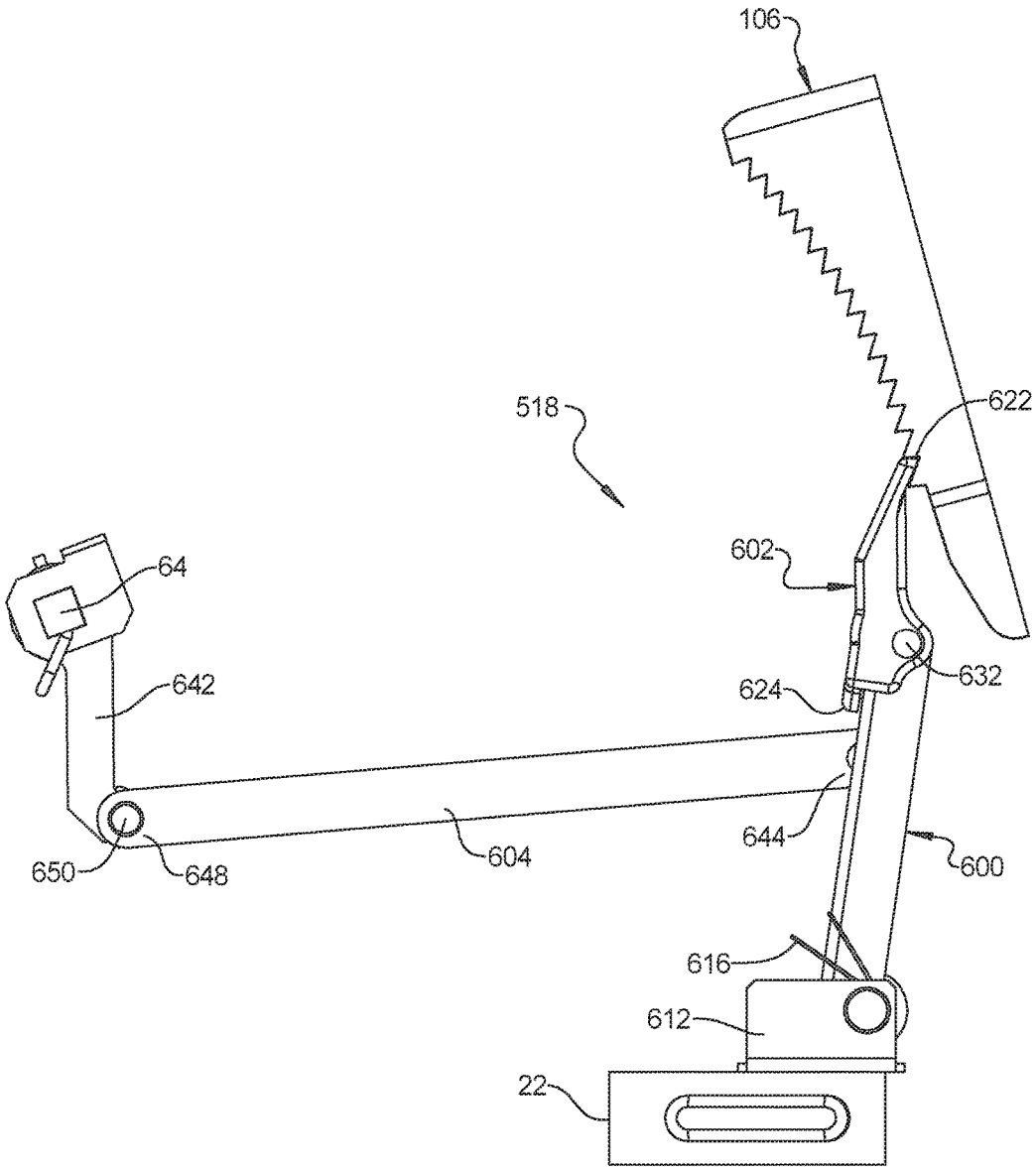
FIG. 19 is a side view of another configuration of a pawl assembly in the engaged position.
Figure 20:
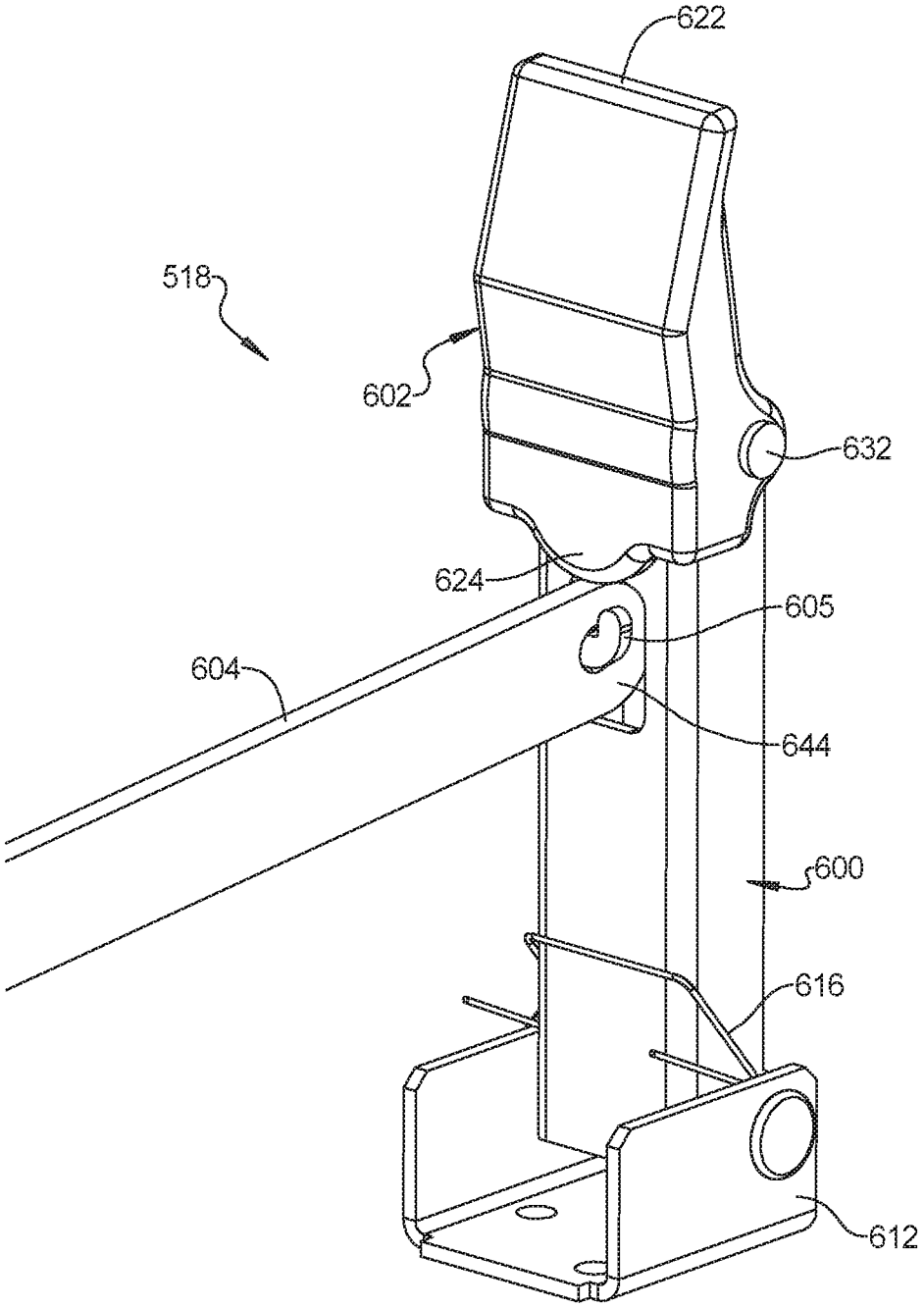
FIG. 20 is a partial perspective view of the pawl assembly in the position of FIG. 19.
Figure 21:
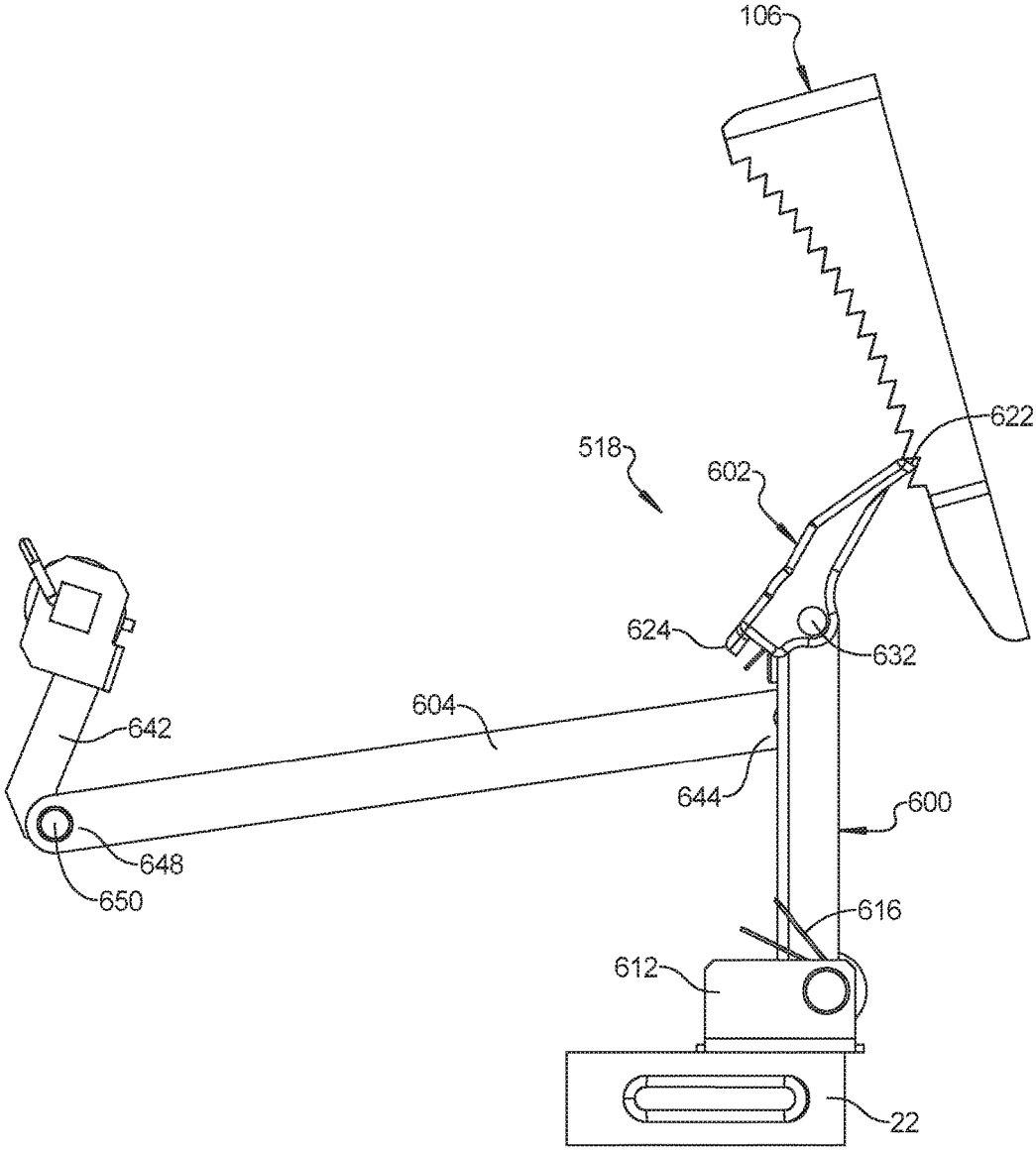
FIG. 21 is a side view of the pawl assembly of FIG. 19 releasing from the engaged position.
Figure 22:
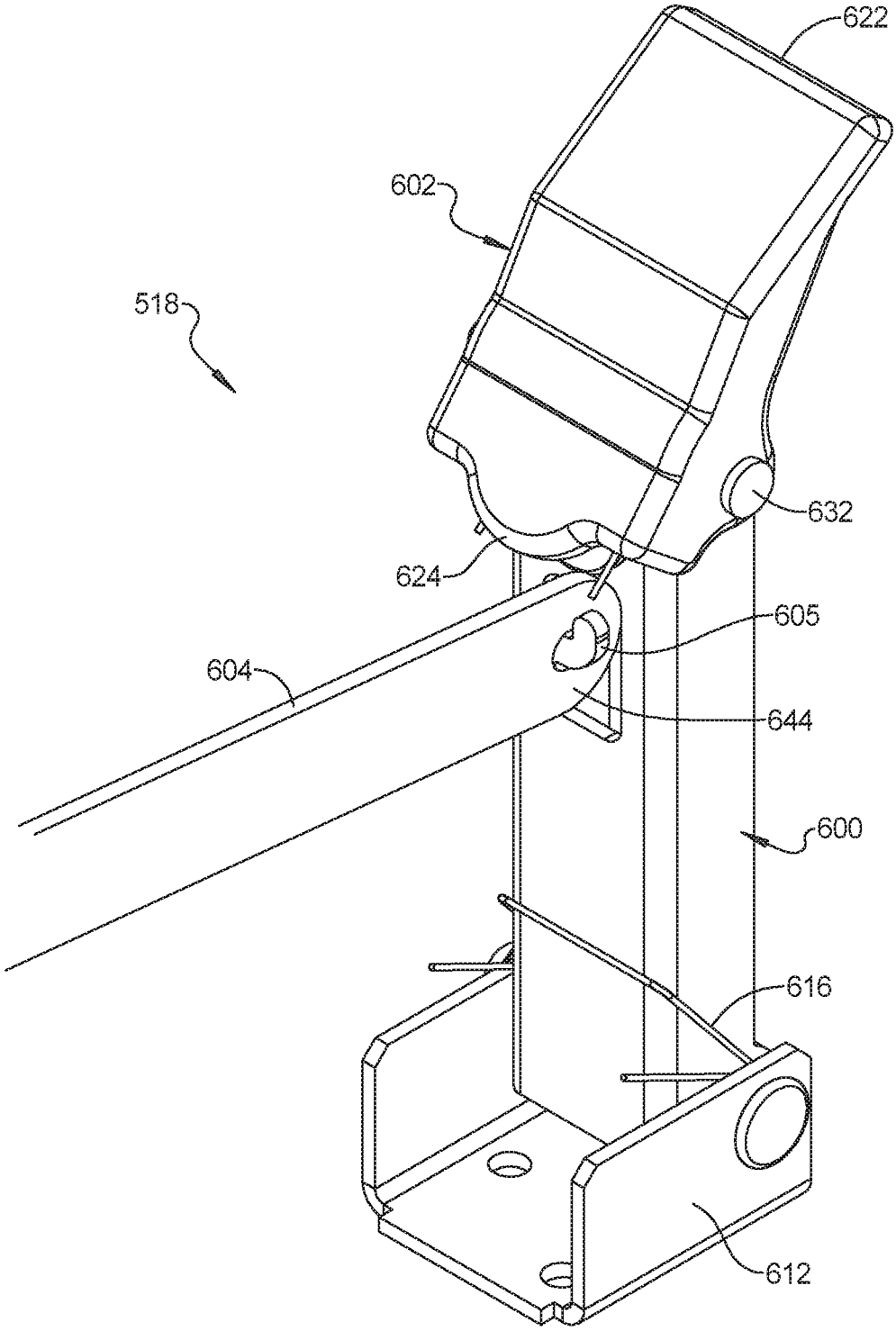
FIG. 22 is a partial perspective view of the pawl assembly in the position of FIG. 21.

The pawl arm 602 may be a rigid body including a first end 622 and a second end 624. The first end 622 includes an edge that is sized to engage a selected one of a plurality of ratchet teeth 128 of the ratchet rack 106, as shown in FIG. 19. The pawl arm 602 may be rotatably coupled to the support link 600 at a location that is between the first and second ends 622, 624. For example, a pin 632 may extend through the end of the support link 600 and through the pawl arm 602 to connect the pawl arm 602 to the support link 600 for relative rotation therebetween. In this manner, the pawl arm 602 is rotatable relative to the support link 600 between a first rotational position (FIGS. 19, 20, and 24) and a second rotational position (FIGS. 21-23). A torsion spring 634 (FIG. 24) may engage the support link 600 and the pawl arm 602 and may rotationally bias the pawl arm 602 relative to the support link 600 in a second rotational direction (i.e., in counterclockwise direction when viewed from the frame of reference of FIG. 18) toward the first rotational position.

As shown in FIGS. 23 and 24, the pawl arm 602 may include a generally cylindrical recess 636 formed therein. The recess 636 may be sized to receive at least a portion of the damper 618 on the support link 600 when the pawl arm 602 is in the first rotational position. An axial end surface 638 of the damper 618 may contact a surface 640 of the pawl arm 602 (i.e., an axial end surface that defines an axial end of the recess 636), as shown in FIG. 24. As shown in FIG. 23, when the pawl arm 602 is in the second rotational position relative to the support link 600, the axial end surfaces 638, 640 are spaced apart from each other, and the damper 618 may be disposed outside of the recess 636.

As shown in FIGS. 19 and 21, the actuation link 604 may be rotatably coupled to the support link 600 and to a crank link 642 (similar or identical to crank link 142). That is, as shown in FIGS. 20 and 22, a first end 644 of the actuation link 604 may be rotatably coupled to a hook 605 formed on the support link 600. As shown in FIGS. 19 and 21, a second end 648 of the actuation link 604 is rotatably coupled to the crank link 642 via a pin 650. The crank link 642 is rotationally fixed to the drive rod 64.

In some configurations, the ratchet rack 106, 208 is formed from a different material than a material from which at least the first end 122, 422, 622 of the pawl arm 102, 402, 602 is formed. For example, some or all of the pawl arm 102, 402, 602 could be formed from a polymeric or composite material, and the ratchet rack 106, 208 could be formed from a metallic material. As another example, some or all of the pawl arm 102, 402, 602 could be formed from a metallic material, and the ratchet rack 106, 208 could be formed from a polymeric or composite material. The dissimilar materials of the portions of the pawl arm 102, 402, 602 and ratchet rack 106, 208 that contact each other can reduce the noise associated with contact and friction therebetween.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base frame;

a seat assembly including a seat frame, a seat bottom, and a seat back, the seat assembly movable relative to the base frame between a nominal position and a rearward-tilt position, the seat frame including a ratchet rack having a plurality of ratchet teeth;

a legrest mechanism mounted to the seat assembly and movable relative to the seat assembly between a retracted position and an extended position; and a pawl assembly including a support link, a pawl arm, and an actuation link, the support link is rotatably coupled to the base frame, the pawl arm is rotatably attached to the support link and selectively engages the ratchet teeth, the actuation link is attached to the pawl arm and is coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack.

2. The furniture member of claim 1, wherein an end of the pawl arm selectively engages one of the ratchet teeth, wherein the pawl arm includes a first location at which the pawl arm is rotatably attached to the support link and a second location at which the actuation link is rotatably attached to the pawl arm, and wherein the first location is disposed between the second location and the end of the pawl arm.

3. The furniture member of claim 1, wherein the pawl assembly includes a first spring rotationally biasing the support link relative to the base frame and a second spring rotationally biasing the pawl arm relative to the support link.

4. The furniture member of claim 1, wherein:

the support link includes a protrusion, the pawl arm includes a recess, when the pawl arm is in a first rotational position relative to the support link, a portion of the protrusion is received within the recess and contacts a surface of the pawl arm defining the recess, and when the pawl arm is in a second rotational position relative to the support link, the portion of the surface of the protrusion is disposed outside of the recess and is spaced apart from the surface of the pawl arm defining the recess.

5. The furniture member of claim 4, wherein the protrusion is formed from a first material, and wherein a body of the support link to which the protrusion is attached is formed from a second material that is different than the first material.

6. The furniture member of claim 5, wherein the first material is an elastomeric material or a polymeric material.

7. The furniture member of claim 1, wherein the seat assembly is free to rock relative to the base frame between the nominal and rearward-tilt positions when the legrest mechanism is in the retracted position, and wherein engagement between the pawl arm and one of the ratchet teeth restricts rocking relative to the base frame between the nominal and rearward-tilt positions when the legrest mechanism is in the extended position.

8. The furniture member of claim 1, wherein the seat frame includes a bracket having a first bracket end and a second bracket end, wherein the ratchet rack includes a first rack end and a second rack end, wherein a pin extends through apertures in the first bracket end and the first rack end, and wherein a tab formed on the second rack end is received in an aperture formed in the second bracket end.

9. The furniture member of claim 1, wherein the pawl arm is rotatable relative to the support link about a first rotational axis, wherein the pawl arm and the actuation link are rotatable relative to each other about a second rotational axis, and wherein the first rotational axis is disposed vertically between the second rotational axis and an end of the pawl arm that engages the ratchet rack.

10. The furniture member of claim 1, wherein the ratchet rack is formed from a different material than a material from which at least an end of the pawl arm is formed.

11. The furniture member of claim 1, wherein an end of the pawl arm engages a tooth of the ratchet rack when the legrest mechanism is in the extended position, and wherein the end of the pawl arm rotates along the tooth of the ratchet rack to disengage the pawl arm from the ratchet rack as the legrest mechanism moves toward the retracted position.

12. A furniture member comprising:

a base frame;

a seat assembly including a seat frame, a seat bottom, and a seat back, the seat assembly movable relative to the base frame between a nominal position and a rearward-tilt position, the seat frame including a ratchet rack having a plurality of ratchet teeth;

a legrest mechanism mounted to the seat assembly and movable relative to the seat assembly between a retracted position and an extended position; and a pawl assembly including a support link and a pawl arm, the support link is rotatably coupled to the base frame and includes a protrusion, the pawl arm is rotatably attached to the support link and selectively engages the ratchet teeth, wherein the pawl arm is rotatably relative to the support link between a first rotational position in which the protrusion contacts the pawl arm and a second rotational position in which the protrusion is spaced apart from the pawl arm.

13. The furniture member of claim 12, wherein the protrusion is formed from a first material, and wherein a body of the support link to which the protrusion is attached is formed from a second material that is different than the first material.

14. The furniture member of claim 13, wherein the first material of the protrusion is an elastomeric material or a polymeric material.

15. The furniture member of claim 13, wherein the pawl assembly includes an actuation link, and wherein the actuation link is attached to the pawl arm and is coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack.

16. The furniture member of claim 15, wherein the pawl arm includes a recess, wherein a portion of the protrusion is received within the recess when the pawl arm is in the first rotational position, and wherein the portion of the protrusion is disposed outside of the recess when the pawl arm is in the second rotational position.

17. The furniture member of claim 16, wherein an end of the pawl arm selectively engages one of the ratchet teeth, wherein the pawl arm includes a first location at which the pawl arm is rotatably attached to the support link and a second location at which the actuation link is rotatably attached to the pawl arm, and wherein the first location is disposed between the second location and the end of the pawl arm.

18. The furniture member of claim 17, wherein the pawl assembly includes a first spring rotationally biasing the support link relative to the base frame and a second spring rotationally biasing the pawl arm relative to the support link.

19. The furniture member of claim 18, wherein the seat assembly is free to rock relative to the base frame between the nominal and rearward-tilt positions when the legrest mechanism is in the retracted position, and wherein engagement between the pawl arm and one of the ratchet teeth restricts rocking relative to the base frame between the nominal and rearward-tilt positions when the legrest mechanism is in the extended position.

20. The furniture member of claim 19, wherein the pawl arm is rotatable relative to the support link about a first rotational axis, wherein the pawl arm and the actuation link are rotatable relative to each other about a second rotational axis, and wherein the first rotational axis is disposed vertically between the second rotational axis and an end of the pawl arm that engages the ratchet rack.

21. The furniture member of claim 12, wherein the seat frame includes a bracket having a first bracket end and a second bracket end, wherein the ratchet rack includes a first rack end and a second rack end, wherein a pin extends through apertures in the first bracket end and the first rack end, and wherein a tab formed on the second rack end is received in an aperture formed in the second bracket end.

22. The furniture member of claim 12, wherein the pawl assembly includes an actuation link, wherein the actuation link is attached to the support link and is coupled to the legrest mechanism such that movement of the legrest mechanism into the extended position moves the support link, which moves the pawl arm into engagement with the ratchet rack, and wherein movement of the legrest mechanism toward the retracted position disengages the pawl arm from the ratchet rack.

23. The furniture member of claim 12, wherein the ratchet rack is formed from a different material than a material from which at least an end of the pawl arm is formed.

24. The furniture member of claim 12, wherein an end of the pawl arm engages a tooth of the ratchet rack when the legrest mechanism is in the extended position, and wherein the end of the pawl arm rotates along the tooth of the ratchet rack to disengage the pawl arm from the ratchet rack as the legrest mechanism moves toward the retracted position.

25. A furniture member comprising:

a base frame;

a seat assembly including a seat frame, a seat bottom, and a seat back, the seat assembly movable relative to the base frame between a nominal position and a rearward-tilt position, the seat frame including a ratchet rack having a plurality of ratchet teeth;

a legrest mechanism mounted to the seat assembly and movable relative to the seat assembly between a retracted position and an extended position; and a pawl assembly including a support link, a pawl arm, and an actuation link, the support link is rotatably coupled to the base frame, the pawl arm is rotatably attached to the support link and selectively engages one of the ratchet teeth, the actuation link is attached to the pawl arm and is coupled to the legrest mechanism such that movement of the legrest mechanism into the extended position moves the pawl arm into engagement with the ratchet rack and movement of the legrest mechanism toward the retracted position causes rotation of the pawl arm relative to the support link and disengages the pawl arm from the ratchet rack, wherein a protrusion extends from the support link in a direction perpendicular to an axis about which the pawl arm is rotatable relative to the support link, and wherein the pawl arm is rotatably relative to the support link between a first rotational position in which the protrusion contacts the pawl arm and a second rotational position in which the protrusion is spaced apart from the pawl arm.

26. The furniture member of claim 25, wherein the seat frame includes a bracket having a first bracket end and a second bracket end, wherein the ratchet rack includes a first rack end and a second rack end, wherein a pin extends through apertures in the first bracket end and the first rack end, and wherein a tab formed on the second rack end is received in an aperture formed in the second bracket end.

27. The furniture member of claim 25, wherein an end of the pawl arm selectively engages one of the ratchet teeth, wherein the pawl arm includes a first location at which the pawl arm is rotatably attached to the support link and a second location at which the actuation link is rotatably attached to the pawl arm, and wherein the first location is disposed between the second location and the end of the pawl arm.

28. The furniture member of claim 25, wherein the pawl arm includes a recess, wherein a portion of the protrusion is received within the recess when the pawl arm is in the first rotational position, and wherein the portion of the protrusion is disposed outside of the recess when the pawl arm is in the second rotational position.

29. The furniture member of claim 25, wherein the pawl assembly includes a first spring rotationally biasing the support link relative to the base frame and a second spring rotationally biasing the pawl arm relative to the support link.

30. The furniture member of claim 25, wherein the protrusion is formed from an elastomeric material or a polymeric material.

31. The furniture member of claim 25, wherein the pawl arm is rotatable relative to the support link about a first rotational axis, wherein the pawl arm and the actuation link are rotatable relative to each other about a second rotational axis, and wherein the first rotational axis is disposed vertically between the second rotational axis and an end of the pawl arm that engages the ratchet rack.

32. The furniture member of claim 25, wherein the ratchet rack is formed from a different material than a material from which at least an end of the pawl arm is formed.

33. The furniture member of claim 25, wherein an end of the pawl arm engages a tooth of the ratchet rack when the legrest mechanism is in the extended position, and wherein the end of the pawl arm rotates along the tooth of the ratchet rack to disengage the pawl arm from the ratchet rack as the legrest mechanism moves toward the retracted position.

* * * * *